US005191778A

United States Patent [19]

Inagaki et al.

[11] Patent Number: 5,191,778

[45] Date of Patent: Mar. 9, 1993

[54] PROCESS FOR PRODUCING THIN-WEBBED H-BEAM STEEL

[75] Inventors: Akira Inagaki; Masao Kurokawa; Hiroyuki Hasegawa, all of Sakai; Toshihiro Ishibashi, Kitakyushu; Hiroaki Hadano, Kitakyushu; Takeshi Hioki, Kitakyushu; Yoshimi Toriyama, Kitakyushu; Kazuo Fujita, Sakai; Yasushi Takeshima, Sakai; Teruyuki Wakatsuki, Sakai; Yasushi Horiuchi, Sakai, all of Japan

[73] Assignee: Nippon Steel Corporation, Tokyo, Japan

[21] Appl. No.: 719,122

[22] Filed: Jun. 20, 1991

[30] Foreign Application Priority Data

| | | | |
|---|---|---|---|
| Jun. 21, 1990 | [JP] | Japan | 2-161403 |
| Jun. 21, 1990 | [JP] | Japan | 2-161405 |
| Nov. 6, 1990 | [JP] | Japan | 2-298885 |

[51] Int. Cl.[5] ..... B21B 37/10; B21D 37/16; C21D 1/00; C21D 9/00

[52] U.S. Cl. ..... 72/13; 72/201; 72/342.6; 72/365.2; 148/511; 148/641; 148/643; 239/557; 266/134

[58] Field of Search ..... 72/13, 201, 224, 225, 72/342.1, 342.2, 342.5, 342.6, 342.94, 365.2, 366.2; 148/128, 143, 145, 146; 239/75, 76, 99, 124, 443, 444, 551, 557, 562, 565, 566; 266/46, 87, 114, 115, 117, 134, 259

[56] References Cited

U.S. PATENT DOCUMENTS

| | | | |
|---|---|---|---|
| 3,765,660 | 10/1973 | Taylor et al. | 266/134 |
| 3,880,358 | 4/1975 | Schaming | 72/201 |
| 4,016,009 | 4/1977 | Economopoulos et al. | 148/145 |
| 4,486,248 | 12/1984 | Ackert et al. | 148/145 |
| 4,497,180 | 2/1985 | Graham | 72/201 |
| 4,759,504 | 7/1988 | Woodward | 239/76 |
| 4,785,646 | 11/1988 | Uekaji et al. | 72/201 |
| 4,810,311 | 3/1989 | Economopoulos | 148/128 |
| 5,050,418 | 9/1991 | Grotepass | 72/201 |

FOREIGN PATENT DOCUMENTS

| | | | |
|---|---|---|---|
| 1527762 | 3/1970 | Fed. Rep. of Germany . | |
| 2543750 | 4/1976 | Fed. Rep. of Germany . | |
| 53-56146 | 5/1978 | Japan . | |
| 57-59003 | 12/1982 | Japan . | |
| 58-34130 | 2/1983 | Japan . | |
| 0047009 | 3/1984 | Japan | 72/201 |
| 60-248818 | 12/1985 | Japan : | |
| 62-174326 | 7/1987 | Japan . | |
| 1-075628 | 3/1989 | Japan | 72/201 |
| 1-205028 | 8/1989 | Japan . | |

OTHER PUBLICATIONS

Patent Abstracts of Japan, vol. 7, No. 114 (C-166) (1259) May 18, 1983.

Patent Abstracts of Japan, vol. 10, No. 122 (C-344) (2180) May 8, 1986.

Patent Abstracts of Japan, vol. 12, No. 22 (C-470) (2869) Jan. 22, 1988.

Patent Abstracts of Japan, vol. 13, No. 510 (C-654) (3858) Nov. 15, 1989.

European Search Report, EP 91 30 5475, dated 09 Mar. 1992.

*Primary Examiner*—Lowell A. Larson
*Assistant Examiner*—Thomas C. Schoeffler
*Attorney, Agent, or Firm*—Kenyon & Kenyon

[57] ABSTRACT

A thin-webbed H-beam steel having a web thinner that flanges is produced by forcibly water cooling the outer surface of the flanges during an intermediate hot rolling prior to a final hot rolling by cooling to less than 700° C., interrupting the cooling to return the temperature to greater than 700° C., and repeating the cooling and interrupting in order to refine the microstructure of the surface of the flanges to a predetermined depth from the surface; final-hot rolling the intermediate-hot rolled H-beam steel; and forcibly water cooling the flanges of the final-hot rolled H-beam steel in a manner such that the web does not wave during this forcible water cooling, and such that upon completion of the forcible water cooling, thermal stress, generated in the web during air cooling to room temperature, does not exceed the buckling strength of the web.

4 Claims, 23 Drawing Sheets

FLANGE SURFACE (×200)

FLANGE SURFACE (×200)

PROCESS FOR PRODUCING THIN-WEBBED H-BEAM STEEL

BACKGROUND OF THE INVENTION

1. Field of the Invention

The present invention relates to a process and an apparatus for producing a thin-webbed H-beam steel having a web thinner than the flanges thereof, in which the occurrence of a wavy web is prevented, the hardening of the flange surfaces when forcibly cooled is suppressed, the time of cooling a hot-rolled H-beam is reduced, and a precise control of the cooling is ensured.

The term "thin-webbed H-beam steel" as used herein denotes an H-beam steel having a web thinner than that specified by the "Japanese Industrial Standard (JIS)" or "American Society for Testing and Material (ASTM)", or having a flange/web thickness ratio larger than that specified thereby.

An H-beam steel is also sometimes referred to as "H-section steel".

2. Description of the Related Art

The thin-webbed H-beam steels, which have a large section modulus with respect to a weight per unit length and are very economical, are usually produced as a welded or built-up H-beam, but recently processes for producing H-beams by hot-rolling have been proposed. One of the most important objects thereof is to prevent the occurrence of a wavy web during cooling of a hot-rolled H-beam, and several practical solutions to this problem have been proposed.

It is well known in the art that the waviness of a web of a thin-webbed H-beam steels occurs when a compressive stress in the web exceeds the buckling strength of the web, which is induced by a residual internal stress due to a difference between the temperatures of the web and the flanges of an H-beam during the cooling from a final hot-rolling temperature.

The present inventors and others have proposed a solution to the problem of a wavy web as disclosed in Japanese Unexamined Patent Publication (Kokai) No. 1-205028, which comprises forcibly water cooling the flanges of a final-hot-rolled H-beam steel immediately after the completion of the hot rolling. To ensure that a difference between the flange and the web temperatures upon completion of the cooling is within a desired range, the forcible cooling of the flanges is effected in a manner such that either the cooling time is not longer than an upper limit or the difference between the flange and the web temperatures upon completion of the cooling is not less than a lower limit, as a wavy web does not occur during the cooling within such upper and lower limits, and such that either the cooling time is not less than a lower limit or the difference between the flange and the web temperatures upon completion of the cooling is not more than an upper limit, as a thermal stress, generated in the web during air cooling to room temperature, does not exceed a buckling strength of the web within such lower and upper limits. These upper and lower limits are predetermined with respect to the size of H-beam and the flow quantity density of the coolant water.

The present inventors also proposed another solution to the problem of the occurrence of a wavy web, as disclosed in Japanese Unexamined Patent Publication (Kokai) No. 60-248818, in which a lower limit of the web temperature, at or above which the wavy web occurs during the cooling of a hot-rolled H-beam, is predetermined with respect to the size of a hot-rolled H-beam, an H-beam having a temperature higher than the lower limit is gripped at the longitudinal ends to suppress the thermal contraction, the flanges are then forcibly cooled to cause a tensile plastic deformation in the section, and simultaneously, reduce the difference between the flange and the web temperatures, and thereafter, the ends are freed from the suppression.

Japanese Unexamined Patent Publication (Kokai) No. 58-34130 discloses a process for producing an H-beam steel having a reduced residual stress. This process determines a difference between the flange and the web temperatures corresponding to a target residual stress, composes a formula expressing a residual stress of H-beam as a function of the flange and the web temperatures upon completion of the final hot rolling and of the section size of the hot-rolled H-beam, and by using the formula, determines a final hot rolling temperature corresponding to the target residual stress, and adjusts the flange and the web temperatures to the thus determined final hot rolling temperature.

Japanese Unexamined Patent Publication (Kokai) No. 62-174326 discloses an apparatus for spraying a coolant over the flanges of an H-beam steel, using two types of nozzles to spray a coolant over different portions of the flange so that a uniform temperature distribution is ensured for the flange and the flange cooling efficiency is also improved. More specifically, the two types of nozzle include a nozzle for spraying a coolant generally over the whole flange surface and a nozzle for spraying a coolant selectively over mid-width portion of a flange, which has a highest temperature.

Japanese Examined Patent Publication (Kokoku) No. 57-59003 discloses a process in which the flange and the web temperatures of an H-beam, which has not been final-hot-rolled, are measured, the temperatures of predetermined cooling spots of the H-beam are estimated from the measured temperatures, a difference between the estimated temperatures is determined, and the cooling power of forcible cooling apparatuses provided at the predetermined cooling spots is adjusted based on a gap between the estimated temperature difference and an allowable temperature difference. The cooling power is usually expressed as a product of the following three terms: a flow quantity per unit area or a flow quantity density; the flange width; and a flange length over which the cooling is effective or a cooled flange length. A known apparatus used for the forcible cooling comprises a coolant water path having a flow regulating valve and a flow meter inserted therein in series, in which the coolant flow is adjusted by a feedback control.

The above-mentioned Japanese Patent Publication Nos. 60-248818 and 1-205028 use a forcible cooling effected in a manner such that the difference between the flange and the web temperatures is reduced, to provide a basic solution to the problem of the occurrence of a wavy web of thin-webbed H-beam steels during cooling. The former, Japanese Patent Publication No. 60-248818, however, has a disadvantage in that it needs a lot of equipment for suppressing the thermal contraction of an H-beam steel; the latter, Japanese Patent Publication No. 1-205028 does not need such special equipment and is more advantageous in practical use.

Nevertheless, in Japanese Patent Publication No. 1-205028, the allowable cooling time range between the upper and the lower limits must be very small in accordance with the flange and the web temperatures upon the initiation of the flange cooling, and particularly, when the web has a very small thickness or the flange/-web thickness ratio is very large, a variation of temperature over the length of a rolled material causes a problem such that the wavy web cannot be completely prevented, and in turn, the product yield is lowered. It is also disadvantageous in that, to prevent the wavy web due to flange cooling, a long cooling time is necessary and the productivity becomes unavoidably poor.

The present inventors also found that the cooling of flange according to Japanese Patent Publication No. 1-205028 effectively prevents the wavy web, but sometimes causes a quench hardening of the flange, i.e., the flange surface hardness becomes too high. It is known that boring and other working is generally difficult when an H-beam steel has a too high surface hardness, and particularly, the quench-hardened surface has an extremely high yield point (YP) and tensile strength (TS) and a poor elongation, and thus a desired mechanical property cannot be obtained. The inventors also found that the increase in the surface hardness is most remarkable when producing thin-webbed H-beam steels by using a forcible flange cooling.

SUMMARY OF THE INVENTION

An object of the present invention is to completely prevent the wavy web of thin-webbed H-beam steels, to simultaneously reduce the water cooling time, and to prevent an increase in the surface hardness due to a quench hardening caused by the forcible cooling.

The conventional proposals do not provide satisfactory solutions to the above problems.

Japanese Unexamined Patent Publication (Kokai) No. 58-34130 causes a problem in that, to prevent the occurrence of the wavy web, the forcible flange cooling must be terminated before the initiation of the final hot rolling, but this accelerates the quench hardening of the flange and lowers the temperature at which a final hot rolling is effected, which often impairs the mechanical property of the product H-beam.

The cooling proposed by Japanese Unexamined Patent Publication (Kokai) No. 62-174326 is not desirable, because it is well known in the steel metallurgy field that the quench hardening of the flange is accelerated by such a selective strong cooling of the mid-width portion of the flange, which has a higher temperature and a larger grain size, and therefore, is easier to quench-harden than other portions of an H-beam steel.

Another object of the present invention is to provide a solution to the following problem. The above-mentioned Japanese Examined Patent Publication (Kokoku) No. 57-59003 has a drawback in that the cooling control is effected solely by an adjustment of the cooling power to prevent the occurrence of a wavy web of a thin-webbed H-beam steel, in which heat capacities of the flange and the web are significantly different and allowance of differences between the flange and the web temperatures, to prevent the occurrence of a wavy web, is very small, and therefore, the following operational difficulties arise:

(1) The adjustment of the cooling power must be carried out simultaneously with an adjustment of the coolant flow over the flange width, but the control of these adjustments is limited by the equipment used, particularly an interrelationship between valves and the turn-down ratio of the water pressure.

(2) The forcible cooling effected by an adjustment of the rolling speed involves problems in that a slow speed rolling lowers the rolling productivity and that equipment for regulating the cooling power must have a large control allowance sufficient to cover temperature variations along the H-beam length.

A further object of the present invention is to provide an apparatus for forcibly cooling the flange of thin-webbed H-beam steels. Various apparatuses have been proposed for cooling the flange of general H-beam steels during hot rolling, but a more precise control is necessary when forcibly cooling the flange of thin-webbed H-beam steels. Namely, in comparison with the conventional cooling apparatuses, it is essential to minimize fluctuation of the coolant flow upon the initiation and termination of water spray through nozzles, and to improve the precision of the response.

To achieve the above-mentioned objects according to the present invention, there is provided a process for producing a thin-webbed H-beam steel having a web thinner than flanges thereof, which comprises the steps of:

forcibly water cooling the outer surface of the flanges during an intermediate hot rolling prior to a final hot rolling, whereby the flange outer surfaces are cooled to a temperature of 700° C. or lower;

interrupting the forcible water cooling during the intermediate hot rolling so that the flange outer surfaces are returned to a temperature higher than 700° C.;

repeating the forcible water cooling and the interruption thereof during the intermediate hot rolling to refine the microstructure of the flange surface to a predetermined depth from the surface;

final-hot rolling the intermediate-hot rolled H-beam steel; and forcibly water cooling the flanges of the final-hot rolled H-beam steel immediately after the completion of the hot rolling, in a manner such that either the forced cooling time is not longer than an upper limit or the difference between the flange and the web temperatures upon completion of the forced cooling is not less than a lower limit, as the wavy web does not occur during the forced cooling within such upper and lower limits, and such that either the cooling time is not less than a lower limit or the difference between the flange and the web temperatures upon completion of the cooling is not more than an upper limit, as a thermal stress, generated in the web during air cooling to room temperature, does not exceed a buckling strength of the web within such lower and upper limits, the upper and lower limits being predetermined with respect to the size of H-beam and the flow quantity density of the coolant water.

The present inventive process preferably further comprises:

heating the web simultaneously with the forcible water cooling of the flanges during the intermediate hot rolling, to expand an allowable time range of the forcible water cooling of the flange after the final hot rolling, this range being defined by the upper and lower limits, and to reduce the forcible cooling time.

The present inventive process also preferably further comprises:

using a means for forcibly cooling the flanges, the cooling means being arranged in the intermediate and final hot rolling lines and having separate cooling control zones which are sequentially operated to spray coolant water over an H-beam steel being hot rolled, based on a tracking information of the predetermined positions along the length of the H-beam steel at which the spraying should be carried out.

The present inventive process preferably further comprises:

using a piping system having a gate or valve switchable either to the forcible cooling means when the cooling is effected or to a coolant drain when the cooling is not effected; and switching, during hot rolling, the gates or valves corresponding to the cooling control zones to spray coolant water, based on a calculation incorporating therein the steel conveying speed and the information of temperatures at the predetermined positions along the steel length or based on a predetermined condition, while maintaining a predetermined coolant water flow with respect to the steel size.

According to the present invention, there is provided an apparatus for producing a thin-webbed H-beam steel having a web thinner than flanges, which comprises:

a means for forcibly cooling the flanges, the cooling means being arranged in intermediate and final hot rolling lines and having separate cooling control zones which are sequentially operated to spray coolant water over an H-beam steel being hot rolled, based on a tracking information of the predetermined positions along the length of the H-beam steel at which the spraying should be carried out; and a plurality of flow quantity control blocks disposed in parallel and each having a piping system comprising a three way valve having a water supply side port, a nozzle side port, and a water drain side port, a plurality of on-off valves connected to the nozzle side port and adapted to select nozzles from a nozzle group connected thereto, and a variable throttle mechanism connected to the water drain side port, the throttle mechanism being able to be imparted with a preset value and to be throttled at a predetermined throttling value so that a pressure loss at the water drain side is equal to that at the nozzle side under a preset water flow.

According to the present invention, there is also provided an apparatus for producing a thin-webbed H-beam steel having a web thinner than flanges, which comprises:

a means for forcibly cooling the flanges, the means comprising a plurality of nozzles provided on a plurality of nozzle headers and directed toward and at a downward inclination toward outer surfaces of the flange; coolant water supply lines connected to the nozzle header; and make-up water supply lines separate from the coolant water supply lines and connected to the nozzle headers. Preferably, the nozzle headers are provided with an automatic air vent at the upper portion thereof.

DESCRIPTION OF THE PREFERRED EMBODIMENTS

The following is an explanation of a basic mechanism of the occurrence of the wavy web of H-beam steels, particularly the influence of the condition of the forcible cooling of flange and the time elapsed after termination of the forcible cooling on the flange and the web temperatures and the web stress, etc. The same mechanism is also used in the above-mentioned Japanese Unexamined Patent Publication (Kokai) No. 1-205028, by the same assignee.

Figure 1A:
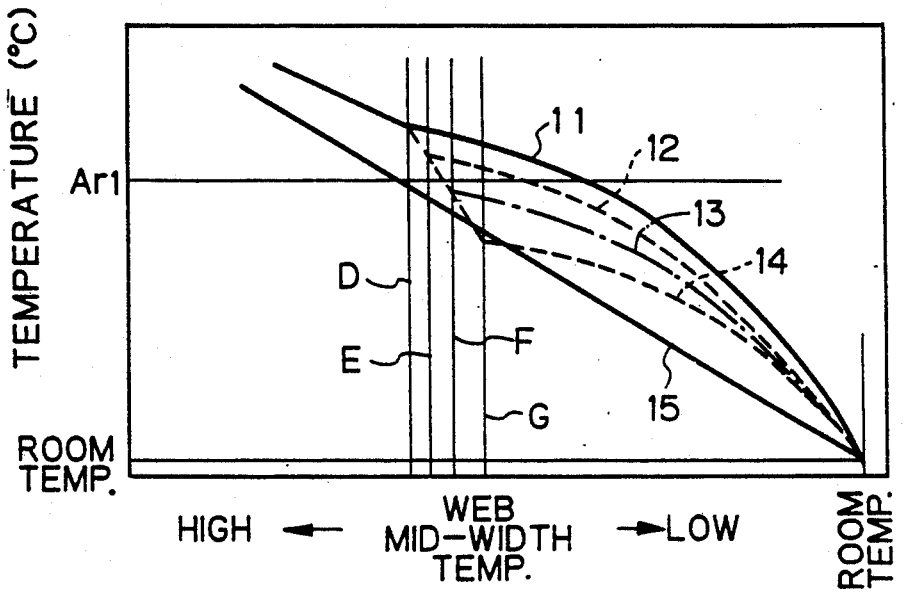
FIG. 1(*a*) exemplifies cooling curves of a hot-rolled H-beam steel when air cooled or water cooled after the hot rolling and FIG. 1(*b*) shows the web stress varying on the temperature shown in FIG. 1(*a*)
Figure 1B:
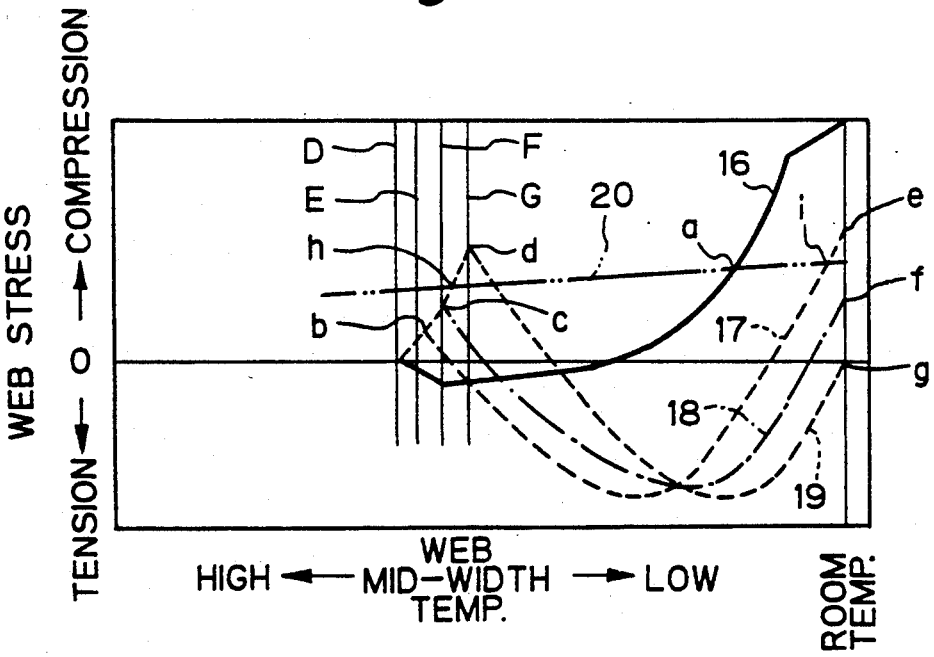

FIG. 1(*a*) exemplifies cooling curves of a hot-rolled H-beam steel when air cooled or water cooled after the hot rolling, and FIG. 1(*b*) shows the web stress varying on the temperature shown in FIG. 1(*a*). The abscissa represents the web temperature of the mid-width portion thereof, in which the temperature falls from left (high) to right (low) as time elapses after the termination of hot rolling.

In FIG. 1(*a*), curve 11 is an air cooling curve of a flange and curves 12–14 are water cooling curves of a flange in which the water forcible cooling was initiated when the web temperature was "D" and the water cooling continued until the web temperature fell to "E", "F", or "G", respectively, i.e., the water cooling time was shortest in the case of curve 12, longest in the case of curve 14, and intermediate in the case of curve 13. The straight line 15 is a cooling curve for the web which was not forcibly cooled with water but was only air cooled to room temperature.

In FIG. 1(*b*), the web stress curves 16–19 correspond to the web cooling curves 11–14 of FIG. 1(*a*), wherein curve 20 represents the buckling strength of web, which is lowered as the web temperature rises. As previously described, the wavy web is caused by an internal compressive web stress larger than the buckling strength. Regarding the thermal stress 16 generated in the web when the flange was air cooled as shown in FIG. 1(*b*), the compressive stress becomes larger as the web temperature falls and reaches the buckling strength 20 at a point "a" to cause the occurrence of the wavy web.

Common to the thermal stress curves 17–19 in which the flange was water cooled, the compressive stress becomes larger as the difference between the flange and the web temperatures becomes smaller during the water cooling, the thermal stress once becomes tensile after the water cooling is terminated and then again becomes compressive. This is because the flange/web temperature difference is reduced by the water cooling of the flange, is once magnified after termination of the water cooling, and is then again reduced. The compressive web stress generated during water cooling is larger when the water cooling time is longer as shown by points "d", "c", and "b", whereas the compressive web stress retained at room temperature is smaller when the water cooling time is longer, as shown by points "g", "f", and "e".

In the case of the longest water cooling or the web stress curve 19, the web stress during water cooling reaches the buckling strength 20 at point "h" to cause the wavy web to occur during the water cooling. In the case of the shortest water cooling or the web stress curve 17, the largest web stress generated during water cooling, denoted as peak "b", is smaller than the buckling strength 20 and no wavy web occurs during the water cooling, but after the water cooling is terminated, the thermal stress reaches the buckling strength 20 at point "i", during the cooling to room temperature.

Thus, the wavy web occurs either during water cooling when the water cooling is too strong or during the cooling to room temperature after termination of the water cooling when the water cooling is too weak. In the case of the intermediate cooling time or the web stress curve 18, the web stress does not reach the web buckling strength wholly through the cooling sequence, i.e., during the water cooling and during air cooling to room temperature after termination of the water cooling, and thus it is possible to prevent the wavy web by using such an intermediate water cooling. Namely, in the thin-webbed H-beam steel, the wavy web cannot be prevented by a water cooling effected in a manner such that merely the flange/web temperature difference is reduced, as conventionally used when minimizing a residual stress of the general H-beam steels.

The present inventors thus proposed a process in the previously mentioned Japanese Unexamined Patent Publication (Kokai) No. 1-205028 by the same assignee, which process comprises a forcible water cooling of the flanges of a final-hot-rolled H-beam steel immediately after the completion of the hot rolling, in a manner such that either the cooling time is not longer than an upper limit or the difference between the flange and the web temperatures upon completion of the cooling is not less than a lower limit, as the wavy web does not occur during the cooling within such upper and lower limits, and such that either the cooling time is not less than a lower limit or the difference between the flange and the web temperatures upon completion of the cooling is not more than an upper limit, as a thermal stress, generated in the web during air cooling to room temperature, does not exceed a buckling strength of the web within such lower and upper limits; the upper and lower limits being predetermined with respect to the size of H-beam and the density of coolant water quantity.

The proposed process prevents the occurrence of the wavy web of a thin-webbed H-beam steel which occurs during a cooling thereof, but has a drawback in that a long cooling time is required and the production efficiency is thus lowered, when the flange/web temperature difference is large upon an initiation of water cooling and the web temperature is low, even for those having the same size, or when the flange/web thickness ratio is large. Moreover, the required strong water cooling causes an undesired change in the material property of the water cooled surface.

This situation will be explained below with reference to FIGS. 2, 3, and 4 and Table 1. In these Figures, the flow quantity density has the same value of 400 $l/m^2$-min.

Figure 2:
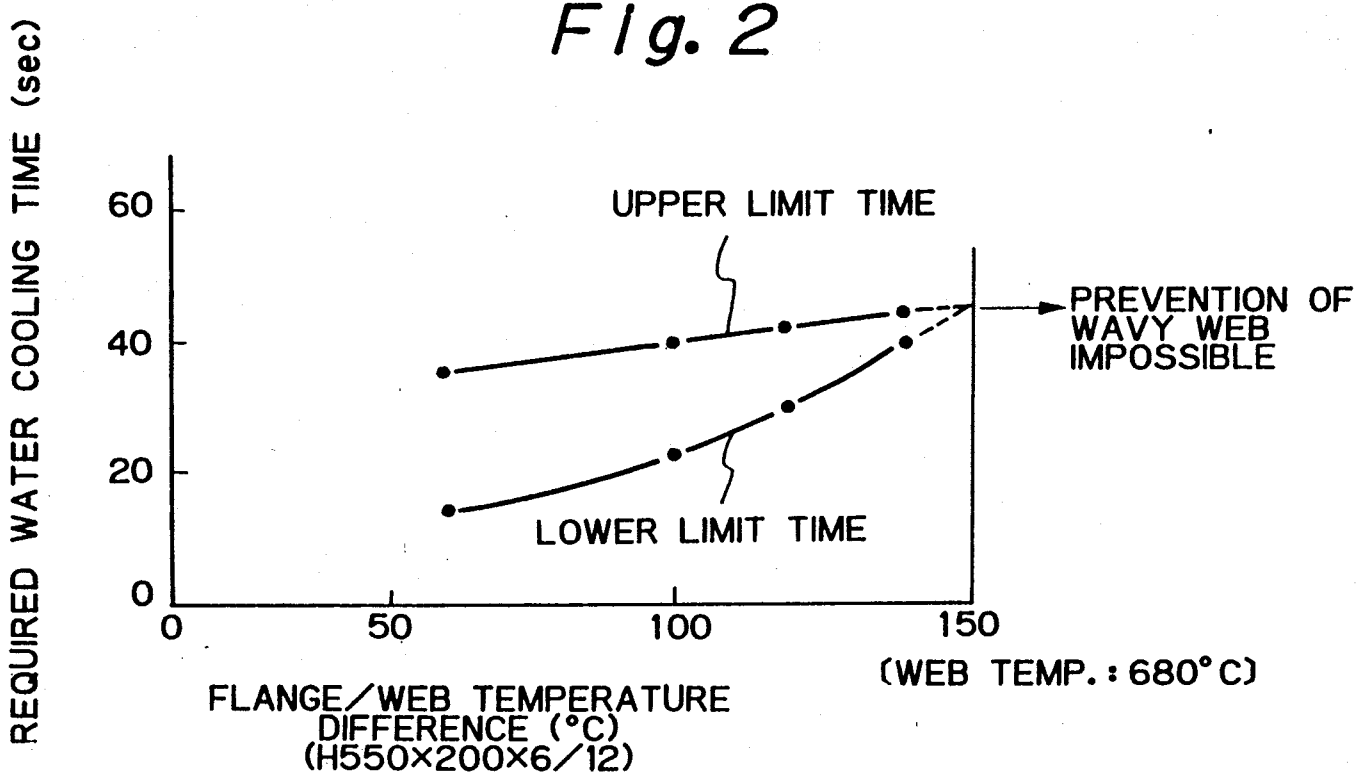
FIG. 2 shows the influence of the flange/web temperature difference upon initiation of water cooling on the allowable range in which the wavy web of a final-hot rolled product is prevented.

FIG. 2 shows the influence of the flange/web temperature difference upon an initiation of water cooling on the allowable range in which the wavy web of a final-hot rolled product is prevented, when the web temperature upon the initiation of water cooling is 680° C. for a thin-webbed H-beam steel having a web height of 550 mm, a flange width of 200 mm, a web thickness of 6 mm, and a flange thickness of 12 mm (designated as "H550×200×6/12). The flange/web temperature difference was intentionally varied by a preliminary water cooling during hot-rolling, prior to the forcible cooling for the prevention of the wavy web. A stronger preliminary water cooling leads to a smaller flange/web temperature difference (represented by the abscissa). It is seen from FIG. 2 that a larger flange/web temperature difference requires a longer water cooling time and reduces the allowable cooling time range, so that it becomes impossible to prevent a wavy web when the flange/web temperature difference is 150° C. or more. It is also seen that, when the flange/web temperature difference is small, i.e., when a strong preliminary water cooling is effected during rolling, the lower limit time is small, so that a short time water cooling can prevent a wavy web.

Figure 3:
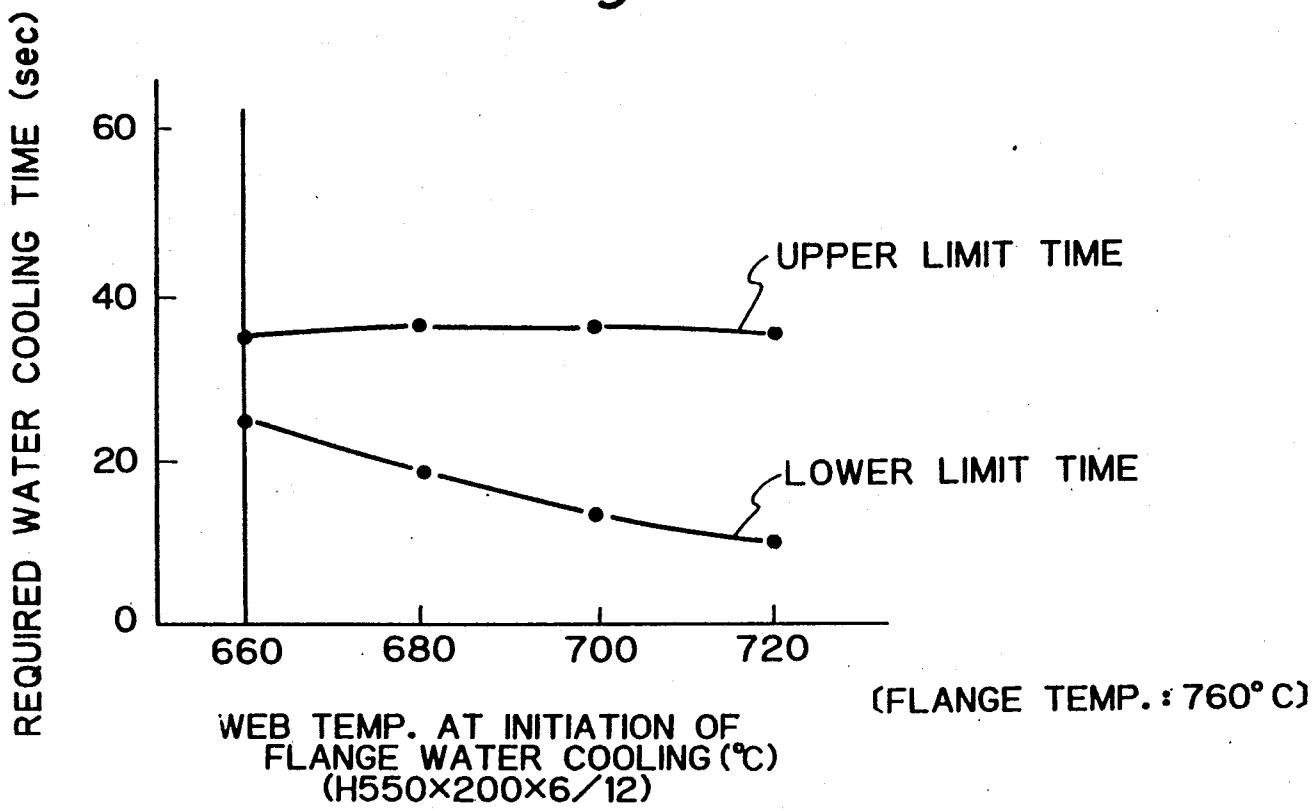
FIG. 3 shows the influence of the web temperature at the initiation of water cooling on the required water cooling time.

FIG. 3 shows the influence of the web temperature at the initiation of water cooling on the required water cooling time, when the water cooling was initiated at the flange temperature of 760° C. for the same steel size of H550×200×6/12, in which the web temperature was varied by a gas flame heating during rolling, and the web temperature was higher for a stronger heating. When the web temperature upon the initiation of the flange water cooling is lower, a longer water cooling time is required and an allowable range of the water cooling time is narrow.

Namely, when the web is heated during rolling, the range of the required water cooling time is wide, which improves the process stability. The lower limit time is also small, so that a short time water cooling can prevent a wavy web, and thus the production efficiency is improved.

Figure 4:
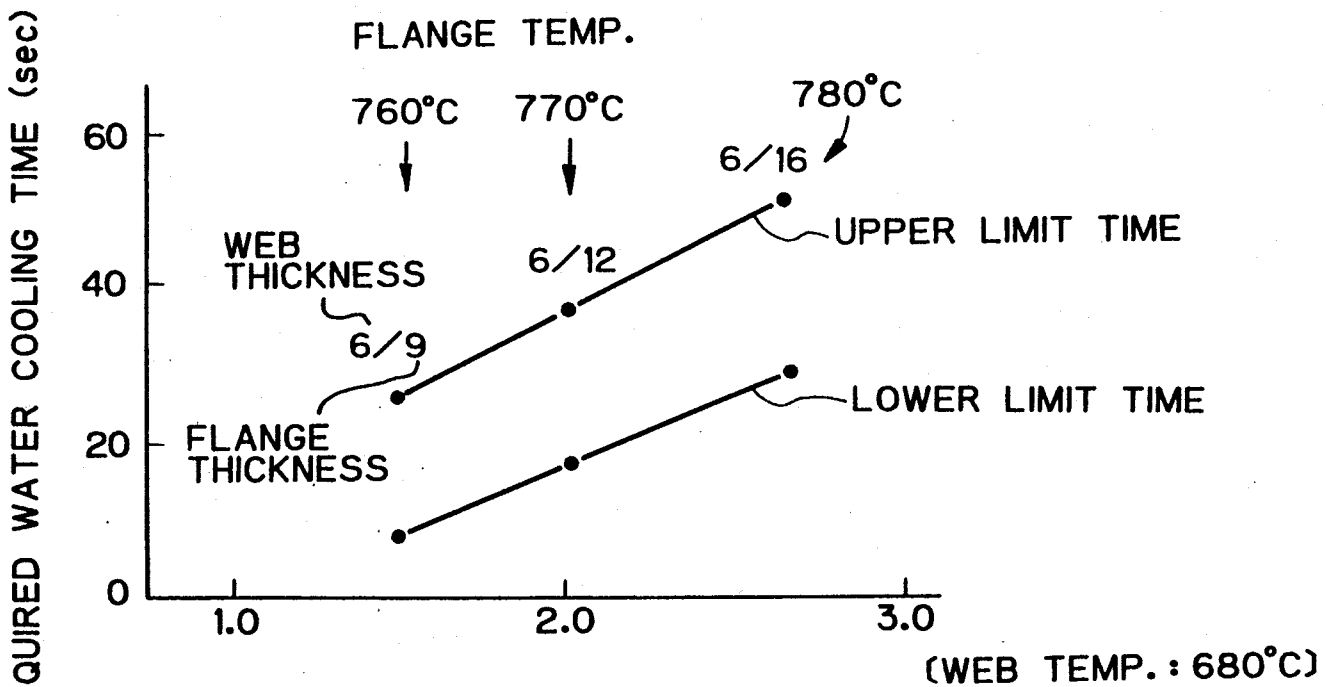
FIG. 4 shows the required water cooling time as a function of the flange/web thickness ratio.

FIG. 4 shows the required water cooling time as a function of the flange/web thickness ratio for a series of H550×200 beam steels having a same web thickness of 6 mm and different flange thicknesses, where water cooling was initiated at a web temperature of 680° C. It is seen from FIG. 4 that, because a thicker flange has a higher temperature at the initiation of water cooling, a larger flange/web thickness ratio requires a longer water cooling time or a stronger water cooling.

As mentioned above, the flange outer surface is quench hardened to an unacceptably high hardness, when the flange temperature at the initiation of water cooling is high or when a longer water cooling is required as in the case of a large flange/web thickness ratio.

Table 1 shows such an example in which, even though the wavy web can be prevented, the flange surface has an extremely high hardness, and therefore, a high strength and a poor elongation, i.e., the flange surface has a bainitic structure, and in comparison with those not water cooled, the surface hardness (HV(10)250) is higher by 90 in terms of the Vickers hardness number and the elongation is lowered by 14%.

TABLE 1

| | Water Cooling Initiation Temperature (°C.) | Water Cooling Termination Temperature (°C.) | Water Cooling Time (sec) | Yield Point (kg/mm²) | Tensile Strength (kg/mm²) | El. (%) | Surface Hardness (HV) |
|---|---|---|---|---|---|---|---|
| Not Water Cooled | — | — | — | 37 | 52 | 30 | 160 |
| Water Cooled | 875 | 580 | 40 | 45 | 65 | 16 | 250 |

Note)
Size: H500 × 200 × 6/16.
Chemical composition (wt %): 0.140 C, 0.35 Si, 1.16 Mn, 0.020 P, 0.006 S, 0.019 Ti.

The present inventors found that the quench hardening by cooling after final rolling is suppressed by refining the microstructure of the flange outer surface prior to the forcible water cooling for the prevention of the wavy web carried out immediately after the completion of the final hot rolling.

Namely, a process according to the present invention comprises the steps of:

forcibly water cooling the outer surface of the flanges during an intermediate hot rolling prior to a final hot rolling, so that the flange outer surfaces are cooled to a temperature of 700° C. or lower;

interrupting the forcible water cooling during said intermediate hot rolling so that the flange outer surfaces are returned to a temperature higher than 700° C.;

repeating said forcible water cooling and said interruption thereof during said intermediate hot rolling to refine the microstructure of the flange surface to a predetermined depth from the surface;

final-hot rolling the intermediate-hot rolled H-beam steel; and forcibly water cooling the flanges of the final-hot rolled H-beam steel immediately after the completion of the hot rolling.

Figure 5:
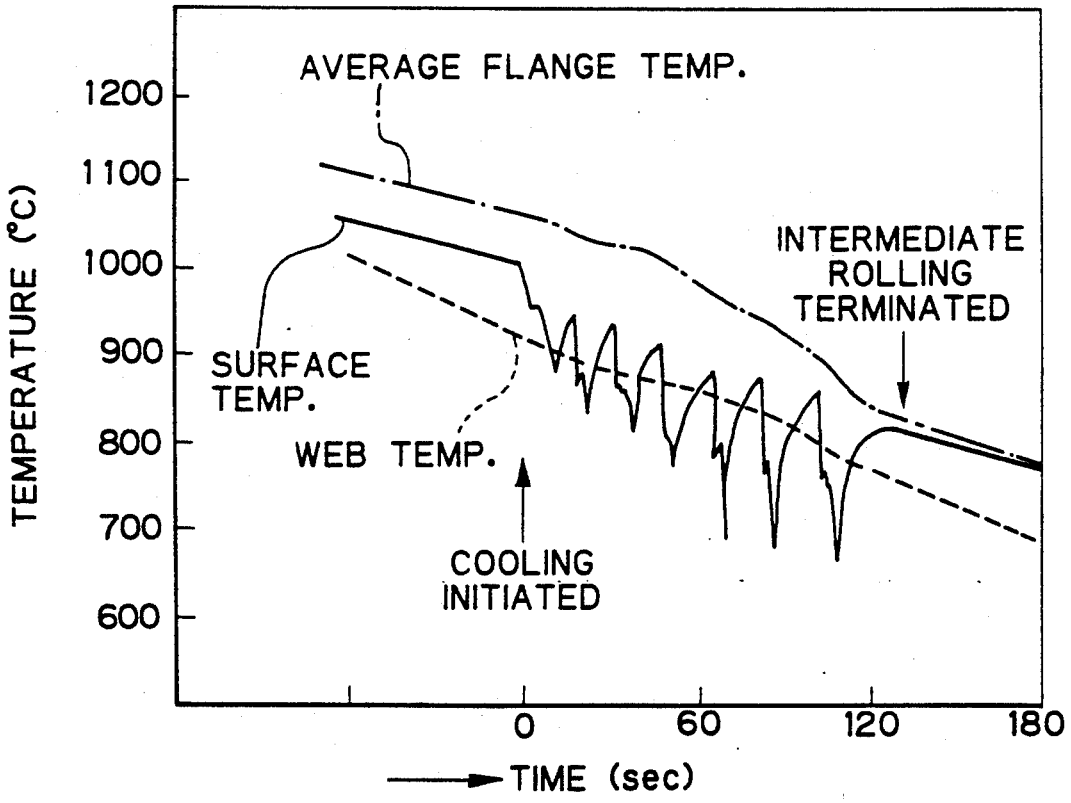
FIG. 5 shows an intermediate rolling sequence in terms of the steel temperature, which varies with time.

FIG. 5 shows an intermediate rolling sequence in terms of the steel temperature, which varies with time. The average flange temperature gradually falls with an elapse of time whereas the flange surface temperature is alternately lowered and recovered to form a sawtooth line. The temperature cooling/recovery procedure during rolling enables the flange outer surface microstructure to be refined by a precipitation of a ferrite phase, refinement of a non-transformed austenite phase, and thereby, lowers the quench hardenability. The cooling-/recovery boundary temperature of 700° C. may vary with the steel chemical composition in a strict meaning, but is available as a guideline when producing thin-webbed H-beam steels having a tensile strength of 40 to 50 kg/mm² according to the present invention. The thus refined-flange surface layer has a depth or thickness depending on the forcible water cooling after final hot rolling, but a thickness of 5 mm or less is sufficient for steels having a flange thickness of 30 mm or less.

In a preferred embodiment of the present invention, the web is heated simultaneously with the water cooling of the flange during an intermediate hot rolling, to further stabilize the process by expanding the allowable cooling time range for the prevention of the wavy web and to ensure a good production efficiency by reducing the lower limit of the cooling time.

Figure 6:
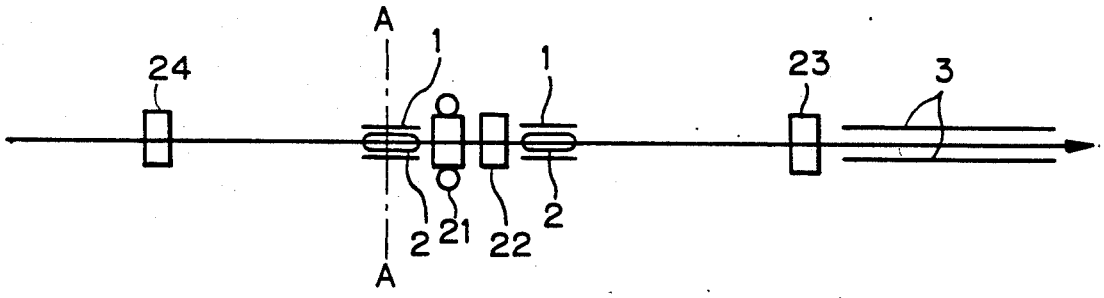
FIG. 6 shows an arrangement for carrying out the present inventive process.
Figure 7:
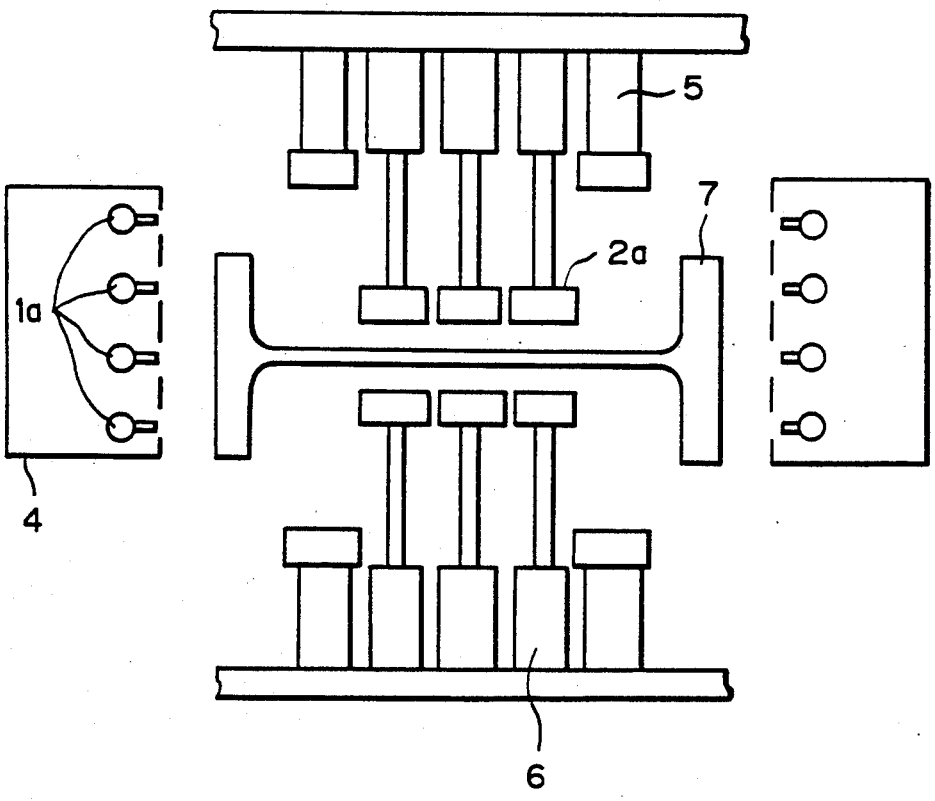
FIG. 7 shows the A—A section of FIG. 6.

FIG. 6 shows an arrangement for carrying out the invention, comprising a break-down mill 24, an intermediate line including a universal mill 21 and a edger mill 22, and a final hot rolling line of a final hot rolling mill 23. Means 1 for water cooling the flange and means 2 for heating the web are disposed both in front and back of the intermediate hot rolling line. A forcible water cooling means 3 for preventing the wavy web is disposed behind the final hot rolling mill 23. FIG. 7 shows the A—A section of FIG. 6. The flange water cooling means 1 has a plurality of nozzles **1*a* disposed for feeding water in accordance with the flange width of an H-beam steel. The nozzles 1*a* are provided in a side guide 4 and are adaptable with respect to the web height. Heater elements 2*a* of the web heating means have level adjusters 5 and 6** for adjusting the element level to match the web conveying level, depending on the flange width, are divided transversely or in the web height direction to correspond to various web inner sizes, and the necessary number of elements can be brought close to the web for heating thereof.

The flange water cooling means 1 and the web heating means 2 may be provided in front and/or back of the intermediate rolling line or may be provided between the universal mill 22 and the edger mill 21. This arrangement makes it possible for one of the flange water cooling and the web heating, or both thereof, to be simultaneously carried out during an intermediate hot rolling, to lower the flange temperature and raise the web temperature upon initiation of the forcible cooling immediately after the completion of a final hot rolling.

A control of the cooling strength in accordance with the steel size and the temperature upon cooling is generally effected by adjusting the cooling power or the rolling speed. The adjustment of the cooling power is limited from the viewpoint of valves used and the turndown ratio of water pressure. The adjustment of the rolling speed has a problem in that, when an H-beam steel has a size requiring a long cooling time, a temperature upon the forcible cooling for the prevention of the wavy web after a final hot rolling varies significantly along the steel length, so that it is difficult to prevent the wavy web at the steel tail having a relatively lower temperature. The present invention provides the following solutions to these problems.

The first solution comprises the use of a means for forcibly cooling the flanges arranged along the intermediate and final hot rolling lines, such a cooling means having separate cooling control zones which are sequentially operated to spray coolant water to an H-beam steel being hot rolled, based on a tracking information of the predetermined positions along the length of said H-beam steel at which the spraying should be carried out.

The second solution comprises the use of a piping system having a gate or valve switchable between the forcible cooling means when a cooling is effected and a coolant drain when a cooling is not effected, and during hot rolling, while maintaining a predetermined coolant water flow with respect to the steel size, switching the gates or valves corresponding to the cooling control zones to spray coolant water, based on a calculation incorporating therein the steel conveying speed and the information of temperatures at the predetermined positions along the steel length or based on a predetermined condition.

Figure 8:
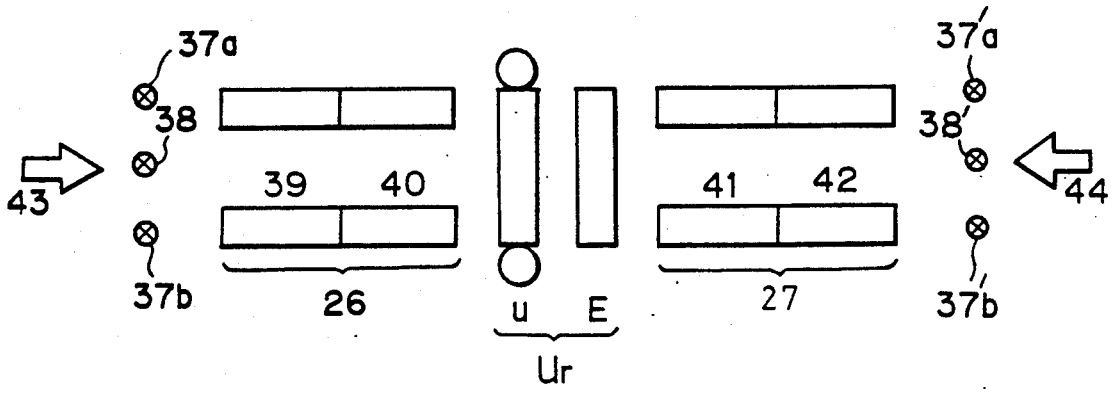
FIG. 8 shows an arrangement according to the present invention.

FIG. 8 shows an arrangement according to the first solution, in which flange forcibly cooling means 26 and 27 are provided on both sides of the steel conveying direction 43 or 44 and in front and back of an intermediate rolling line "Ur" composed of a universal mill "U" and an edger mill "E". The flange forcibly cooling means 26 provided in front of the universal mill "U" is divided into two zones 39 and 40, and the flange forcibly cooling means 27 provided in front of the edger mill "E" is composed of two zones 41 and 42. Flange thermometers 37*a*, 37*b*, 37'*a*, and 37'*b* and web thermometers 38 and 38' are provided in front of or at the steel inlet side of the cooling means 26 and 27, respectively.

When the steel is conveyed rightward or in the direction 43, the flange thermometers 37*a* and 37*b* and the web thermometer 38 measure the flange and the web temperatures, and based on the difference between these temperatures, the necessity of cooling in each zone of the cooling means 26 and 27 is determined by using a computer calculation or a table predetermined by a computer calculation. The positions along the steel length for which the necessity of cooling is determined are then stored in a computer. It is detected that the positions of the steel has passed the zones, based on the tracking information having been obtained for the preceding rollings, and thereafter, the computer instructs the spray of coolant water or the termination of thereof. Control over the whole length of the steel is possible by measuring the flange and the web temperatures at a plurality of arbitrary points along the steel length.

When the steel is conveyed leftward or in the direction 44, the same sequence is used, except that the flange thermometers 37'*a* and 37'*b* and the web thermometer 38' are used. In the above example, two zones are provided in front and back of the intermediate rolling line "Ur", but the number of zones need not be limited to two or the numbers of zones in front and back of the line "Ur" need not be equal.

Figure 9:
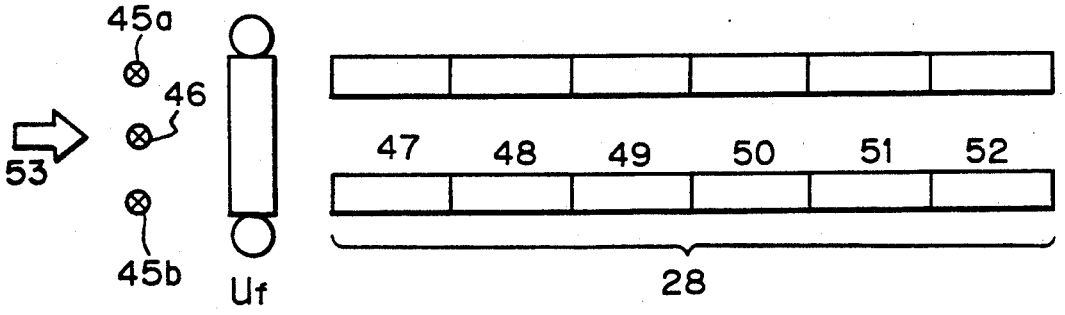
FIG. 9 shows an arrangement according to the present invention.

FIG. 9 shows an arrangement, in which a flange cooling means 28 composed of zones 47 to 52 is provided in back of a final rolling mill "Uf". When the steel is conveyed rightwards, i.e., in the direction 53, flange thermometers 45*a* and 45*b* and a web thermometer 46 are provided in front of the final rolling mill "Uf". The cooling in the final rolling is also controlled in the same way as in the above-mentioned control of the intermediate rolling.

As already mentioned, the cooling power is determined by the flow quantity density fed from a flange cooling means. The flow quantity of coolant water is a product of the flow quantity density determined for steel size, the flange width, and the zone length. To precisely control the coolant water spray to the steel being rolled in each zone, the present invention has the following features.

Figure 10:
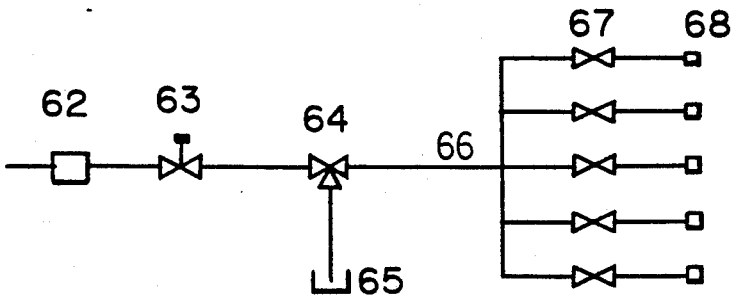
FIG. 10 shows an arrangement of piping, in which a coolant water flows from left to right.
Figure 11:
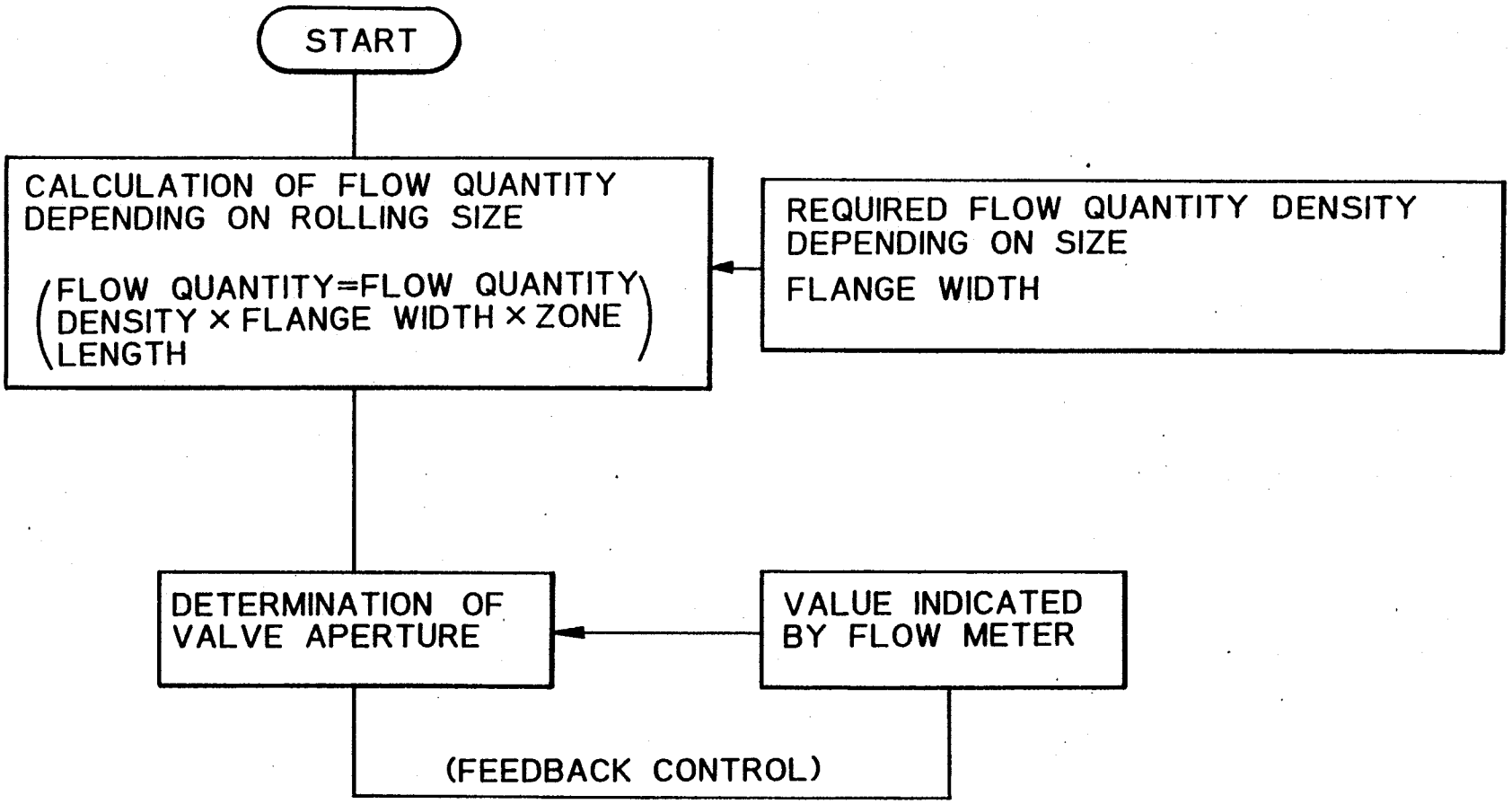
FIG. 11 shows a block diagram of the control of the arrangement of FIG. 10.

FIG. 10 shows an arrangement of piping in which a coolant water flows from left to right. A flow regulating valve 63 has an opening adjusted to a flow quantity preset by a computer and is subjected to a feedback control based on the indicated value of a flow meter 62. A three way valve 64 provided at downstream of the flow regulating valve 63 has two outlets, one connected to a flange cooling means 66 and the other connected to a water drain means 65, which are switched based on a tracking information. FIG. 11 is a block diagram of this control.

Figure 12:
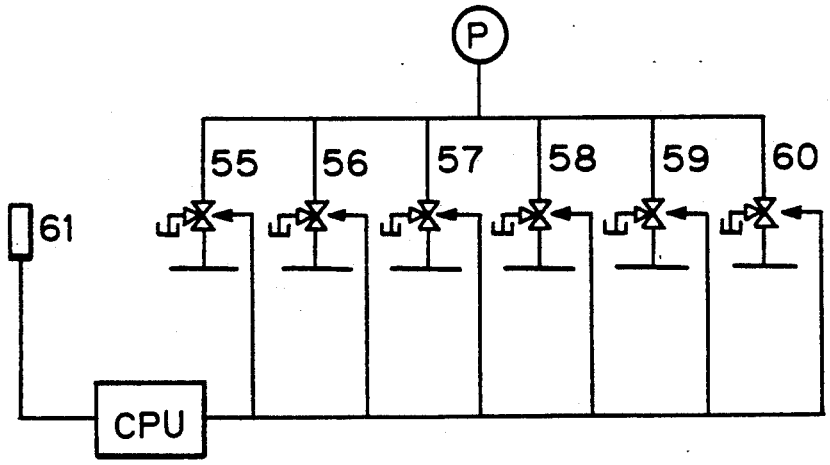
FIG. 12 shows an arrangement in which a plurality of zones having the piping of FIG. 10 are provided.

FIG. 12 shows an arrangement, in which a plurality of zones having the piping of FIG. 10 are provided. When a steel is conveyed from left to right, three way valves corresponding to zones 55 to 60 are switched, sequentially in that order, to the flange cooling means side based on a zone selection instruction by a tracking information.

Figure 13:
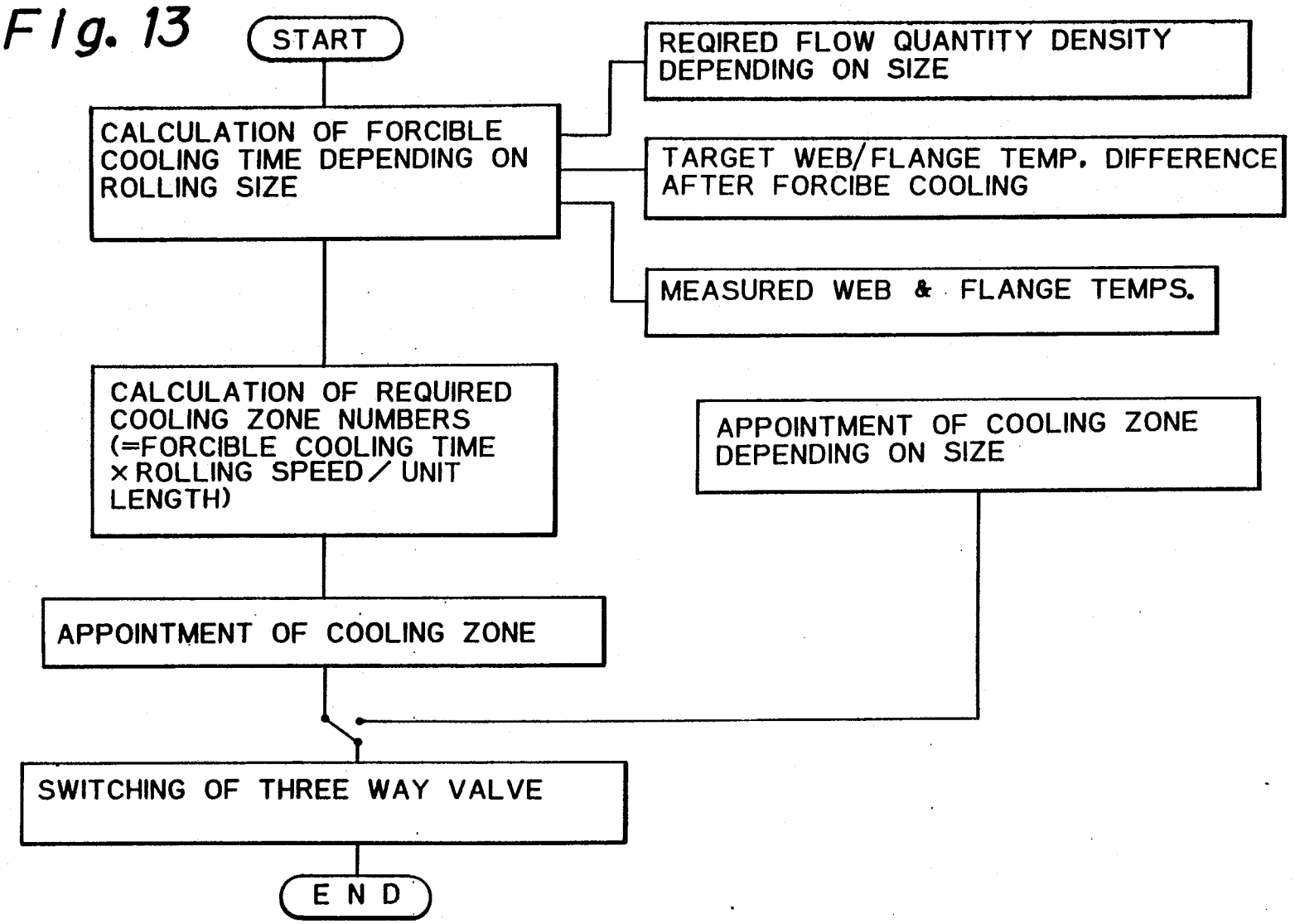
FIG. 13 shows a logic of switching a three way valves for selecting the zones.

FIG. 13 shows a logic of switching three way valves for selecting the zones. The required flow quantity densities and the flange/web temperature differences are predetermined for steel sizes and stored in a computer, are fetched out and used together with the flange and the web temperatures measured during rolling, to calculate the forcible cooling time. The required number of cooling zones is obtained by dividing the product of the forcible cooling time and the steel conveying speed by the length of a single zone of the cooling means. In the rolling of a steel size for which a computer calculation is not necessary, the cooling zone may be determined in advance.

According to another preferred embodiment of the present invention, there is provided an apparatus for minimizing a flow fluctuation upon a switching of valves, by a precise control of the coolant flow through nozzles used in each of the cooling zones of the above-described flange cooling means.

This is achieved by an apparatus according to the present invention, provided with a plurality of flow quantity control blocks disposed in parallel and each having a piping system comprising a three way valve having a water supply side port, a nozzle side port, and a water drain side port, a plurality of on-off valves connected to the nozzle side port and adapted to select nozzles from a nozzle group connected thereto, and a variable throttle mechanism connected to the water drain side port, the throttle mechanism being able to be imparted with a present value and to be throttled at a predetermined throttling value so that a pressure loss at the water drain side is equal to that at the nozzle side under a preset water flow.

Figure 14:
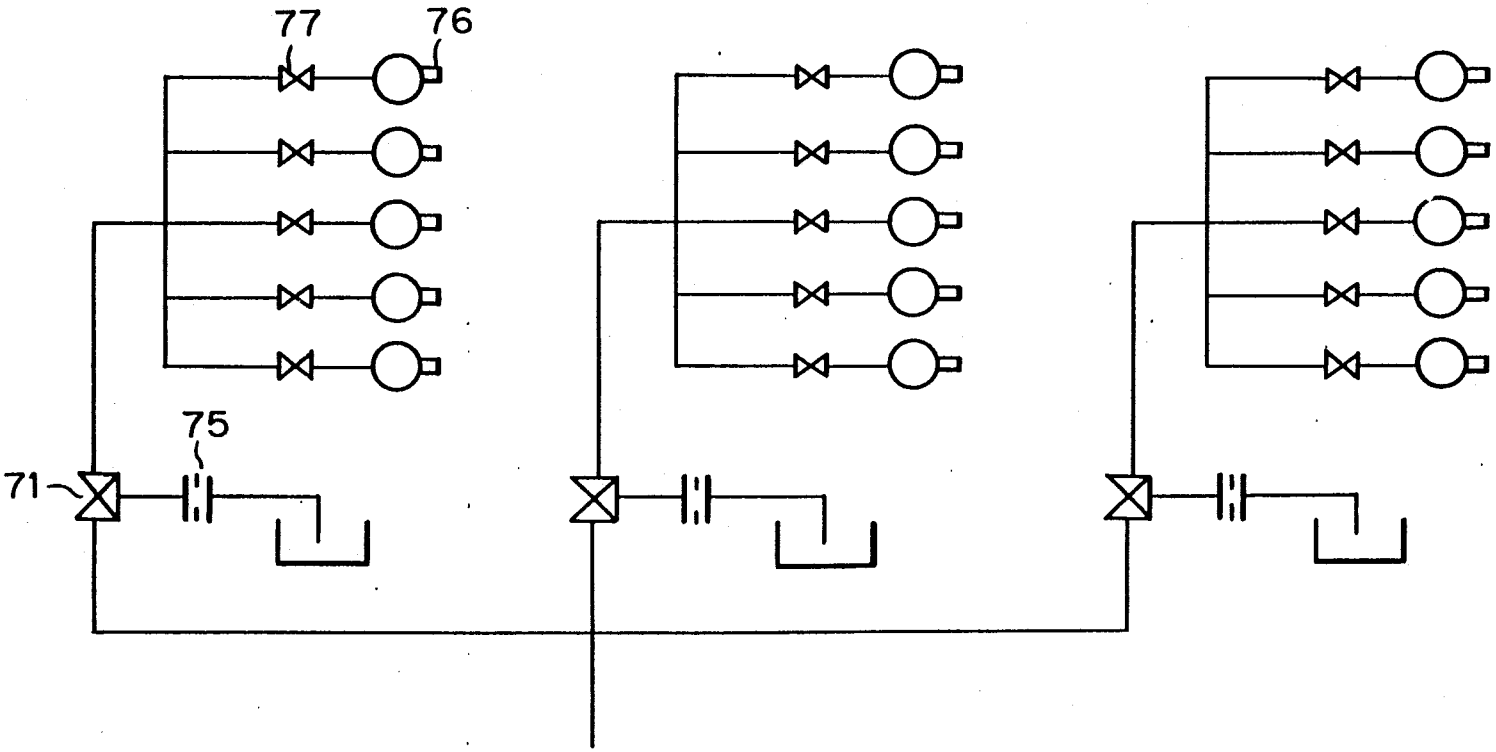
FIG. 14 shows a basic arrangement according to the present invention.

FIG. 14 shows a basic arrangement according to the present invention, which comprises a plurality of flow control blocks disposed in parallel and having a piping system comprising a three way valve 71 having a water supply side port, a nozzle side port, and a water drain side port, a plurality of on-off valves 77 provided at the nozzle side of the three way valve 71 and adapted to select nozzles from a nozzle group 76, and a variable throttle mechanism 75 provided at the water drain side of the three way valve 71.

Figure 15:
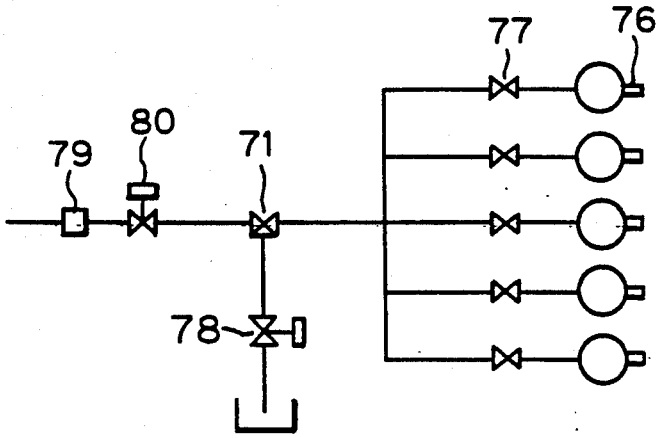
FIG. 15 shows an arrangement for equalizing the pressure losses at the nozzle side and the water drain side of a three way valve under a present flow.

FIG. 15 shows an arrangement for equalizing the pressure losses at the nozzle side and the water drain side of a three way valve under a preset flow. An information of an opening of an opening-adjustable valve 78 is provided by a computer in accordance with a number of nozzles used determined by the condition under which an on-off valve 77 is used, and based on the opening information, the opening-adjustable valve 78 adjusts a piping resistance so that the pressure loss at the nozzle side is equal to that at the water drain side. The nozzles are arranged along the vertical direction to form a plurality of nozzle steps.

The interrelationship between a pressure loss H of a piping system, a flow quantity Q, an inner area A of the piping, and a flow rate V is expressed as:

$$V=Q/A$$

$$H=\rho\times\tfrac{1}{2}\times V^2/g$$

where $\rho$: coefficient of piping resistance, and g: gravitational acceleration.

The pressure loss H is proportional to the square of the flow quantity, i.e., $Q^2$. The pressure loss in the portion downstream of the three way valve 71 is balanced in accordance with the flow quantity, because the resistance $\rho$ is a characteristic value of a piping system and because the downstream portion is open to air.

The pressure loss at the nozzle side is mainly due to the piping to nozzles and the nozzles. When the number of nozzles used is varied, the piping resistance varies and the flow quantity balanced with the nozzle side pressure loss also varies. By equalizing the pressure loss of the drain side of the three way valve to that of the nozzle side, the flow quantity fluctuation upon switching of the three war valve is considered to be caused only by an error in determining the coefficient of piping resistance.

A flow meter 79 and a flow regulating valve 80 are disposed upstream of the three way valve 71 and compose a flow control loop for controlling the flow over the piping system. As described above, when the pressure losses are equalized at both the nozzle side and the drain side, a switching of the three way valve does not cause a flow variation. By utilizing this property, the opening of the opening-adjustable valve 78 provided at the drain side of the three way valve can be determined.

Figure 16:
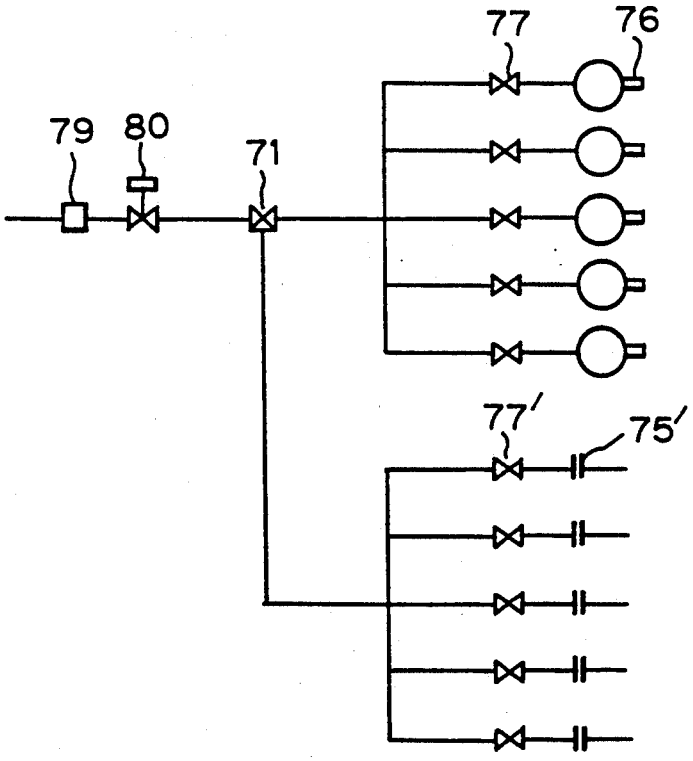
FIG. 16 shows another arrangement for equalizing the pressure losses.

Although an opening adjustment by a single valve is described above, it is possible to use a throttle mechanism provided at the drain side of the three way valve and composed as an assembly of a plurality of throttle mechanisms as shown in FIG. 16, if there is an operational limitation such as a range of flow control. In this case, by selecting or a combination of resistance pipes 75' having different piping resistances, the same effect can be obtained as in the above mentioned adjustment of the opening of an opening-adjustable valve 78 provided at the drain side of the three way valve. This is effected in the following manner.

When the on-off valve 77 is preset, the piping resistance at the nozzle side of the three way valve has a characteristic valve, which can be converted to an opening of the opening-adjustable valve 78 in the following sequence. After presetting the on-off valve 77, the opening of the flow regulating valve 80 is first fixed, a fluid is then allowed to flow in the nozzle side portion of the three way valve, and a flow quantity is checked by the flow meter 79 when a stable flow is established. The three way valve 71 is then switched to the drain side and the opening of the valve 78 is manually changed so that a stable flow quantity is equal to that of the nozzle side. After this equalization is completed, the opening of the three way valve 71 is stored in a table in a computer. The openings of the valve 78, corresponding to the respective conditions under which the on-off valve 77 is used, are also stored. When the piping system of FIG. 16 is used, the on-off valve 77' is preset simultaneously with the presetting of the on-off valve 77 and the throttles of the resistance pipes 75' are adjusted.

Figure 17:
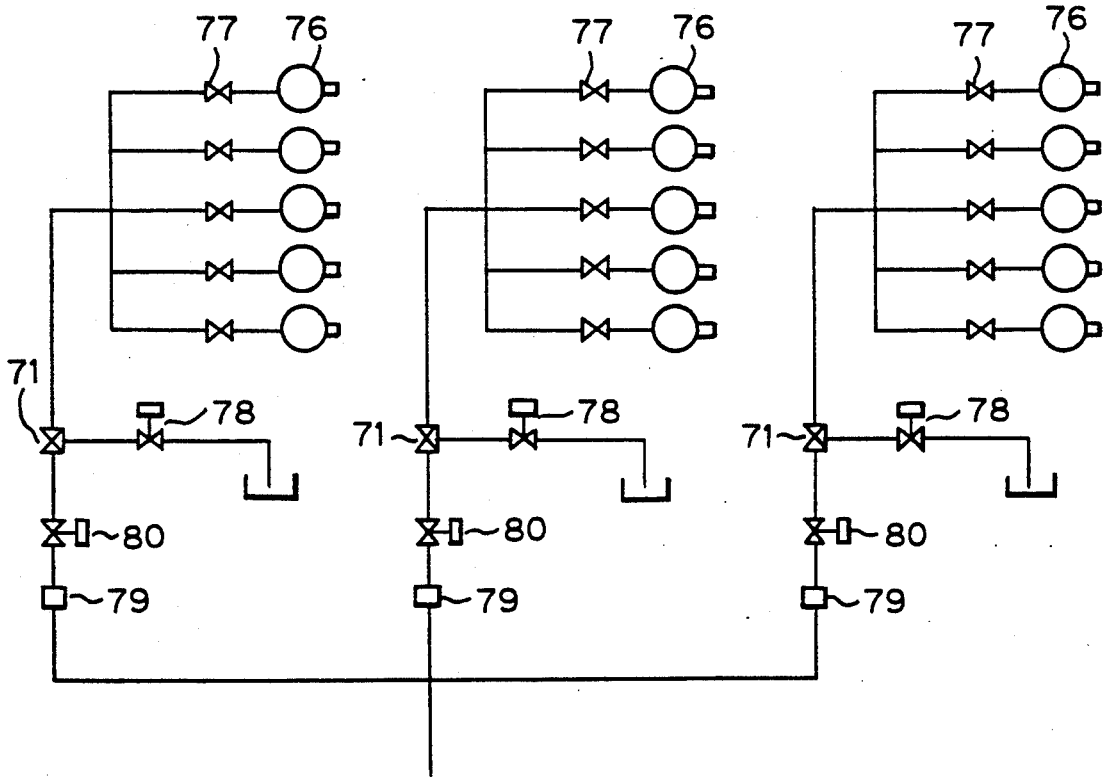
FIG. 17 and 18 show arrangements in which a plurality of the control zones of FIG. 15 are arranged in parallel.
Figure 18:
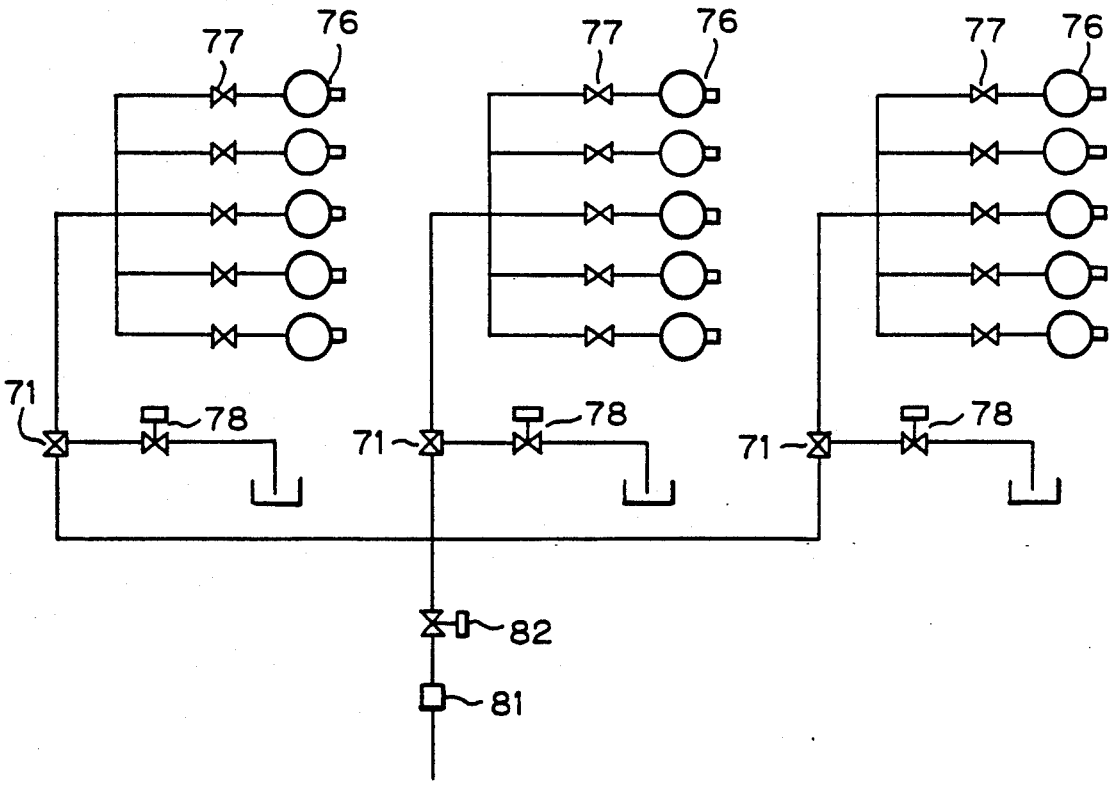

FIGS. 17 and 18 show arrangements in which a plurality of the control zones of FIG. 15 are arranged in parallel. The flow meters 79 and the flow regulating valves 80 can be integrated to a flow meter 81 and a flow regulating valve 82, respectively, as shown in FIG. 18, as long as the adjustment precision of the opening-adjustable valve 78 is ensured. The arrangement of FIG. 18 uses a single flow control loop which covers a plurality of control zones, in which arrangement the openings at the nozzles side and the drain side of the three way valve can be adjusted in accordance with the flow conditions by only switching three way valves to be adjusted, without changing other three way valves of zones not subjected to the adjustment. A flow meter adapted for a larger flow is used in comparison with the adjustment of a single control zone, the control zones can be economically integrated by considering an adjustment precision for the flow measurement error factors.

Figure 19:
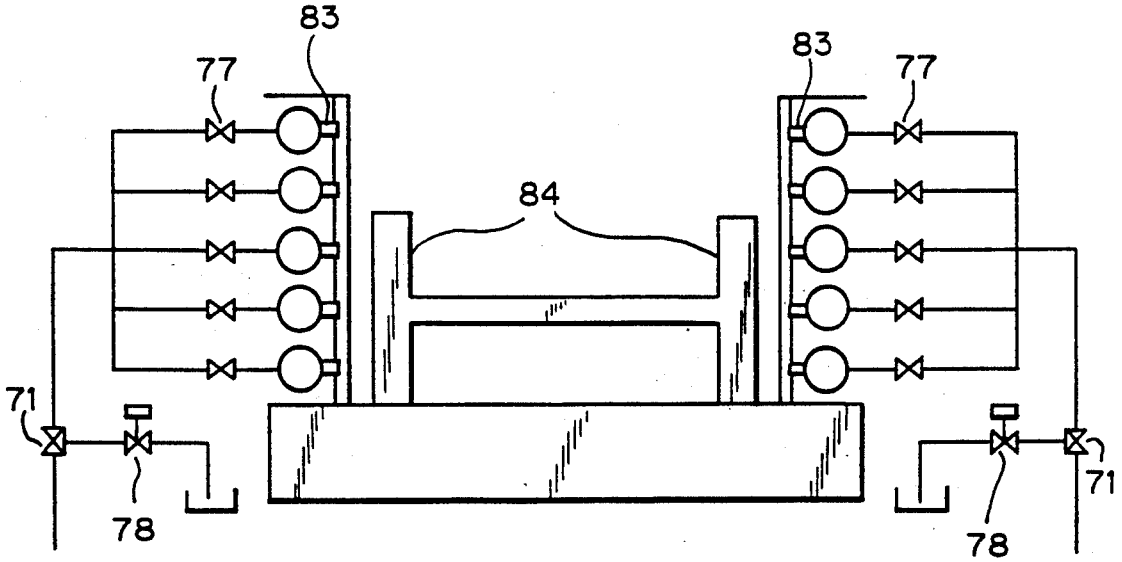
FIG. 19 shows an arrangement according to the present invention when applied to the cooling of the flanges of a thin-webbed H-beam steel.
Figure 20:
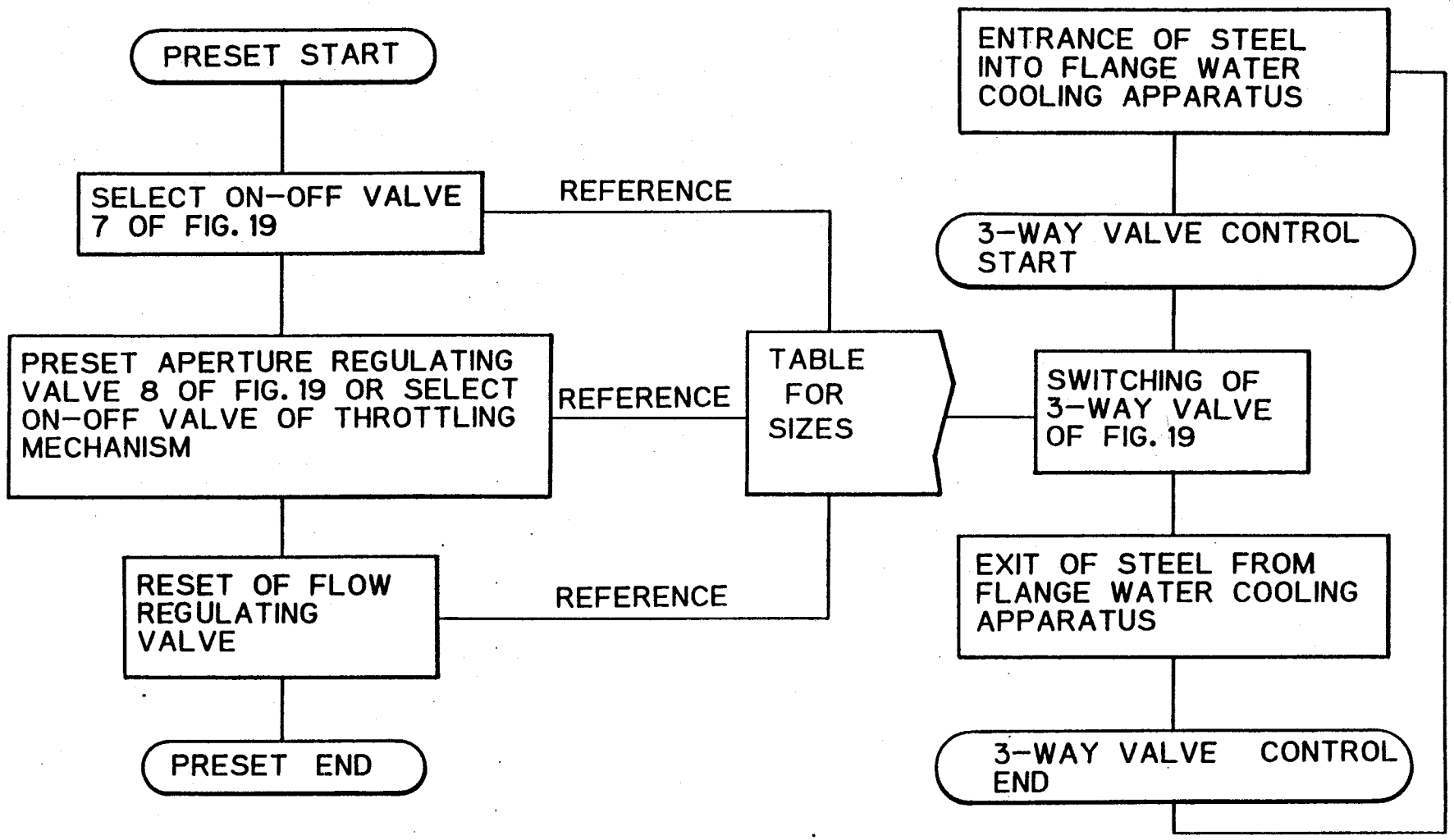
FIG. 20 shows a block diagram of the control of the arrangement of FIG. 19.

FIGS. 19 shows an arrangement according to the present invention when applied to the cooling of the flanges of a thin-webbed H-beam steel. FIG. 20 shows a block diagram of the control of the arrangement shown in FIG. 19.

The flanges 84 are cooled by spraying water through nozzles 83 arranged in a plurality of steps. The selection of the nozzles 83 is effected by presetting the on-off valve 77 of FIG. 19 in a manner such that the necessary nozzle steps are selected in accordance with the flange width. To satisfy a required condition of cooling the steel, the cooling pattern is varied by switching the three way valve either to the nozzle side or to the drain side for a plurality of separate cooling zones as shown in FIGS. 17 and 18.

The opening of the opening-adjustable valve 78 of FIG. 19 is provided by a computer table for each of the control zones, in accordance with the preset of the on-off valve 77. The opening of the opening-adjustable valve 78 has a value which is determined by the adjustment of the piping resistance for the nozzle side and the drain side of the three way valve in the above-mentioned sequence. When a plurality of resistance pipes are used, on-off valves of the resistance pipes are selected.

A presetting or selection of the registered flow quantities for steel sizes is then carried out.

Although the control loop of FIG. 18 is composed by integrating a plurality of control zones, a flow fluctuation upon switching of the three way valve is small, because a flange cooling means has substantially the same piping resistance in the piping portion downstream of the three way valve. The influence on the process operation is minimized, because the presetting of flow by the flow meter 81 and the flow regulating valve 82 of FIG. 18 can be carried out while allowing a fluid to flow in the drain side of the three way valve, i.e., without spraying a coolant water to the rolling line side.

Another embodiment of the present invention provides an apparatus for improving the precision of response of the initiation and the termination of the coolant water spraying through nozzles when supplying coolant water to each of the cooling zones of the above-mentioned flange cooling means.

According to the embodiment, there is provided an apparatus for producing a thin-webbed H-beam steel, in which nozzles mounted on a plurality of nozzle headers are directed downward at an inclination to the flange outer surface of an H-beam steel, coolant water supply lines are connected to the nozzle headers, and make-up water supply lines separate from the coolant water supply lines are also connected to the nozzle headers. The nozzle headers preferably have an automatic air vent in the upper portion thereof.

Figure 21:
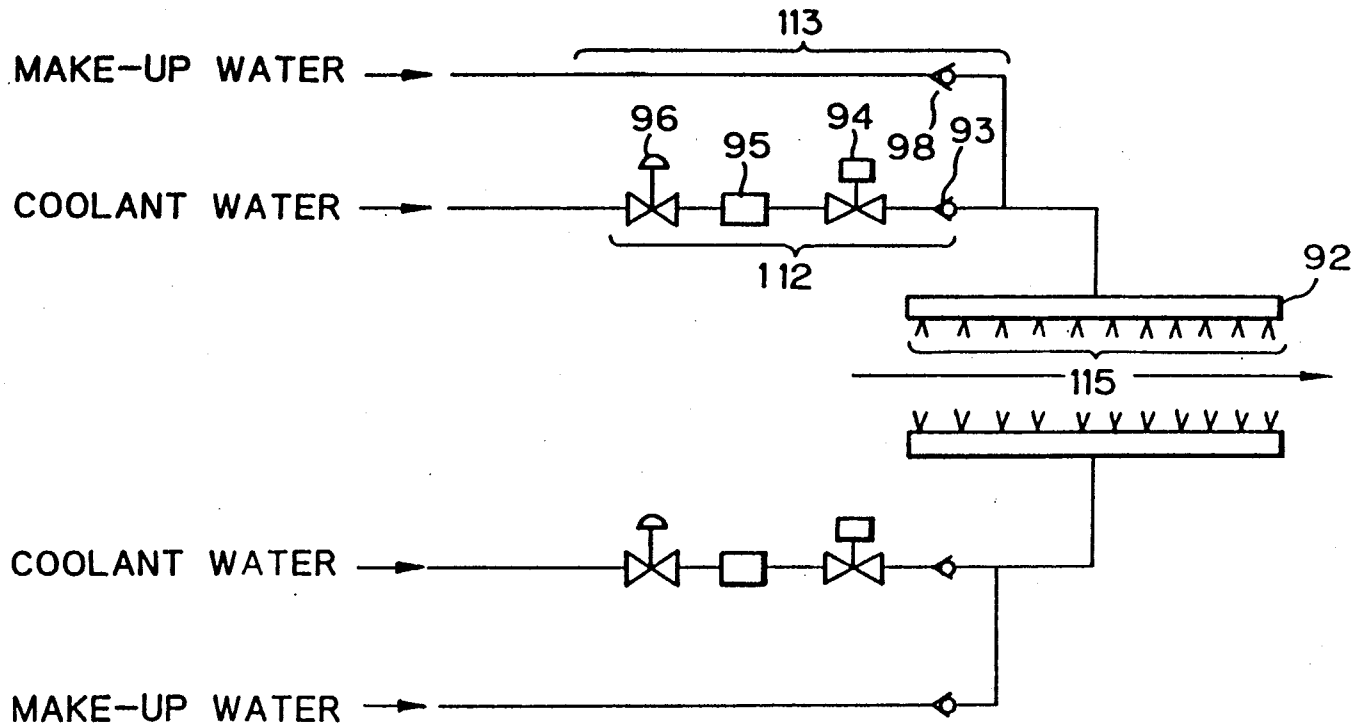
FIGS. 21 and 22 show an apparatus according to an embodiment of the present invention.
Figure 22:
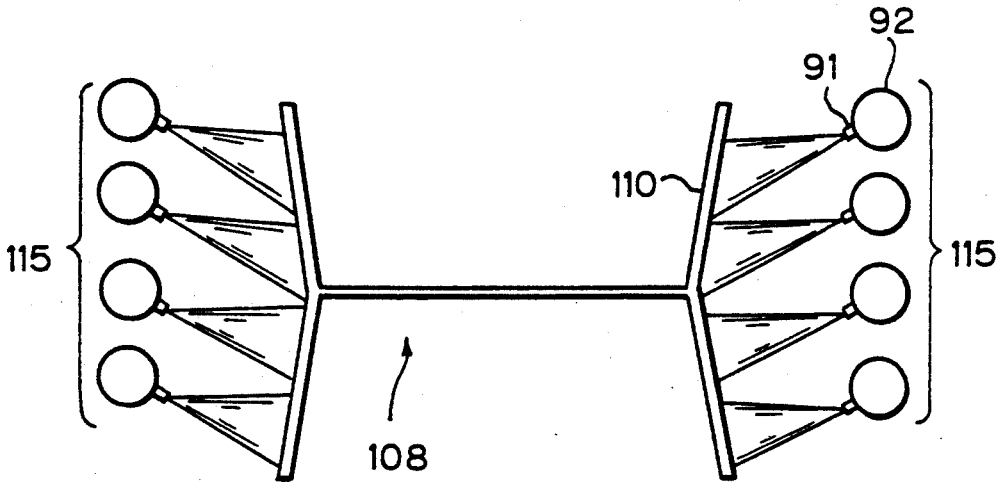

FIGS. 21 and 22 show an apparatus according to this embodiment, having coolant water supply lines 112 and make-up water supply lines 113. The coolant water supply lines 112 have a flow regulating valve 96 for adjusting the flow quantity, a flow meter 95 for measuring the flow quantity, an on-off valve 94 for allowing or interrupting a coolant flow, a check valve 93 for preventing a back flow of coolant water. The make-up water supply lines 113 have a check valve 98 for preventing the coolant water from entering the make-up water lines. The make-up water supply lines 113 are connected to the coolant water supply lines 112 at the downstream of the check valve 93. A coolant water and a make-up water are fed to the nozzle headers 92 and is sprayed through the nozzles 91. A single nozzle header 92 and a plurality of nozzles 91 provided on the nozzle header 92 compose a single cooling unit 115. A pair of cooling units 115 are disposed symmetrically on both sides of an H-beam steel being conveyed to compose a single cooling zone. The nozzles 91 are directed downward at an inclination to the flange outer surface 110 of an H-beam steel.

When the on-off valve is opened, a coolant water fed from the coolant supply line 112 passes the on-off valve 94 to the nozzle header 92 and is then sprayed through the nozzles 91. The water thus sprayed through the nozzles 91 has the same quantity as adjusted by the flow regulating valve 96, because the check valve 98 prevents the coolant water from entering the make-up water supply line 113 and because the make-up water having a lower pressure than the coolant water does not enter the coolant water supply line 112.

When the on-off valve 94 is closed, the coolant water supply is interrupted and the make-up water passes the check valve 98 to the nozzle header 92 and is sprayed through the nozzles 91. The thus sprayed make-up water may have a flow quantity sufficient for preventing an air back flow into the nozzle header 92.

Figure 23A:
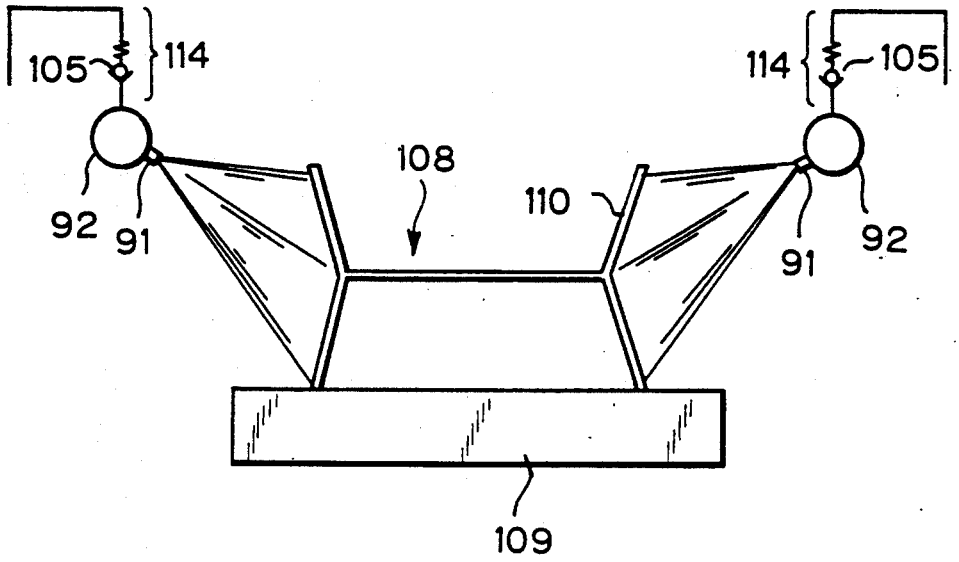
FIGS. 23(*a*), 23(*b*), and 23(*c*) show arrangements in which a nozzle header is provided with an automatic air vent.
Figure 23B:
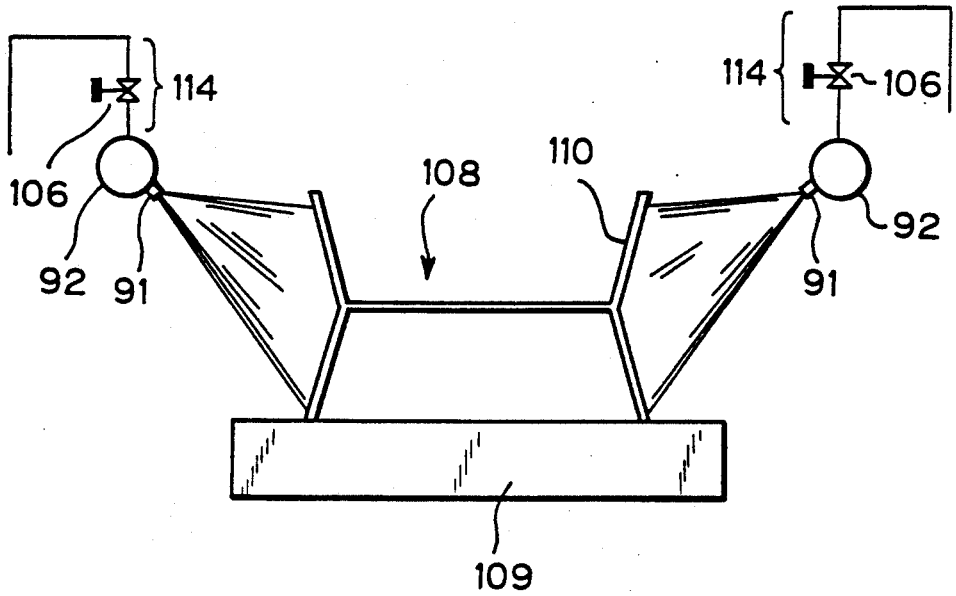
Figure 23C:
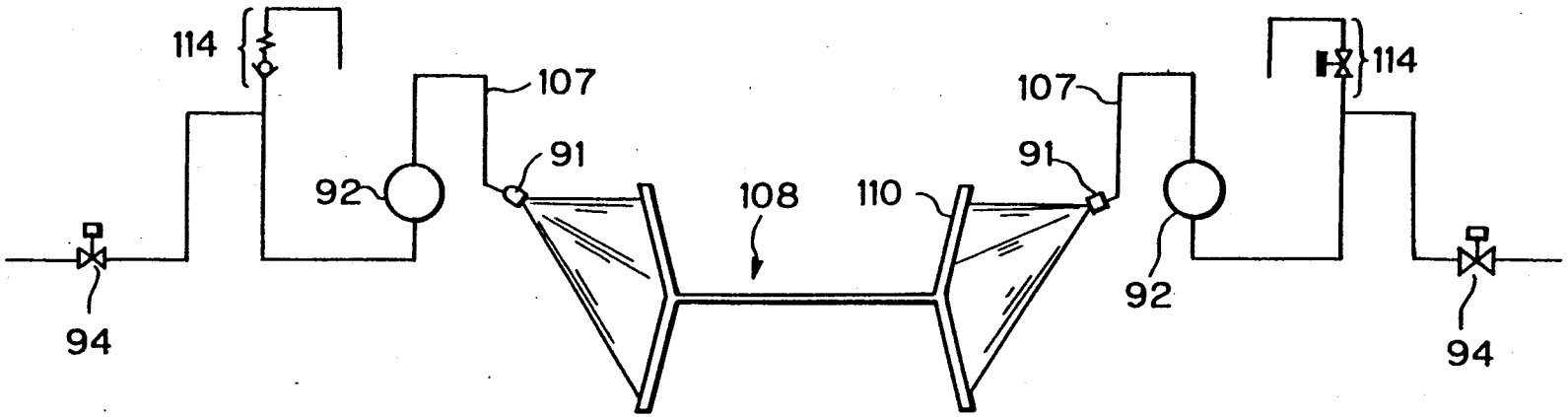

FIGS. 23(*a*), 23(*b*), and 23(*c*) show arrangements, in which a nozzle header is provided with an automatic air vent. An H-beam steel 108 is conveyed on a table roller 109. The arrangement shown in FIG. 23(*a*) has an automatic air vent in the form of a check valve 105 provided on the upper part of a nozzle header 92, the valve 105 having a cracking pressure lower than the coolant water supply pressure. The arrangement of FIG. 23(*b*) has an automatic air vent in the form of an on-off valve 106 provided on the upper part of a nozzle header 92. The inlet to the on-off valve 106 may be connected to the upper portion of the nozzle header 92. The on-off valve 106 is opened and closed corresponding to the opening and closing of the on-off valve 94 of the coolant water supply line 112. In the embodiment of FIG. 23(*c*), an automatic air vent 114 is provided at an extension located between a nozzle header 92 and an on-off valve 94 of a coolant water supply line.

EXAMPLE

A thin-webbed H-beam steel was produced by a process according to the present invention. The product had a web height of 550 mm, a flange width of 200 mm, a web thickness of 6 mm, and a flange thickness of 16 mm, which is designated as "H550×200×6/16", i.e., a typical one having a large flange/web thickness ratio and a large web height with respect to the web thickness.

The following apparatus used was arranged as follows.

(1) An intermediate hot rolling line had a flange water cooling means 1 provided in front of a universal mill 21 and an edger mill 22, as shown in FIG. 6, and divided into two zones such as 39 and 40 (or 41 and 42) of FIG. 8.

(2) At the same position along the steel length as the flange water cooling means 1, a web heating means 2 for heating both sides of the web was provided as shown in FIG. 6. The web heating means 2 had a heating power such that a web having a thickness of 6 mm can be heated by about 10° C. per one pass.

(3) A final-hot rolled H-beam steel was subjected to a water cooling by a flange water cooling means having eleven separate cooling zones.

The temperature control during the intermediate hot rolling was carried out in the manner as summarized in Table 2, in comparison with a conventional intermediate hot rolling.

TABLE 2

| | Flange Water Cooling During Intermediate Hot Rolling | Web Heating During Intermediate Hot Rolling |
|---|---|---|
| Conventional | Not effected | Not effected |
| Invention | Effected in all of 7 passes | Effected in last 2 passes |

Figure 24:
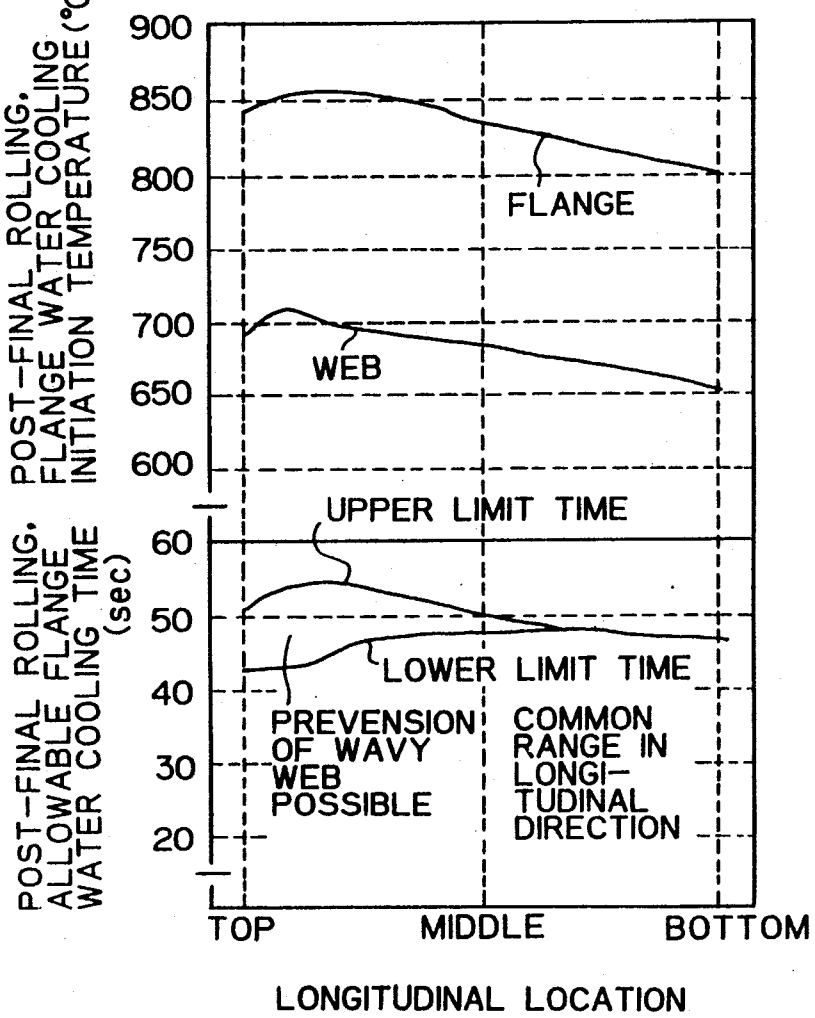
FIGS. 24(*a*) and 24(*b*) show the flange and the web temperatures upon initiation of the flange water cooling for prevention of the wavy web after completion of the final hot rolling and the allowable flange water cooling time predicted from these temperatures, over the steel length, for the conventional process (a) and the present inventive process (b)
Figure 24:
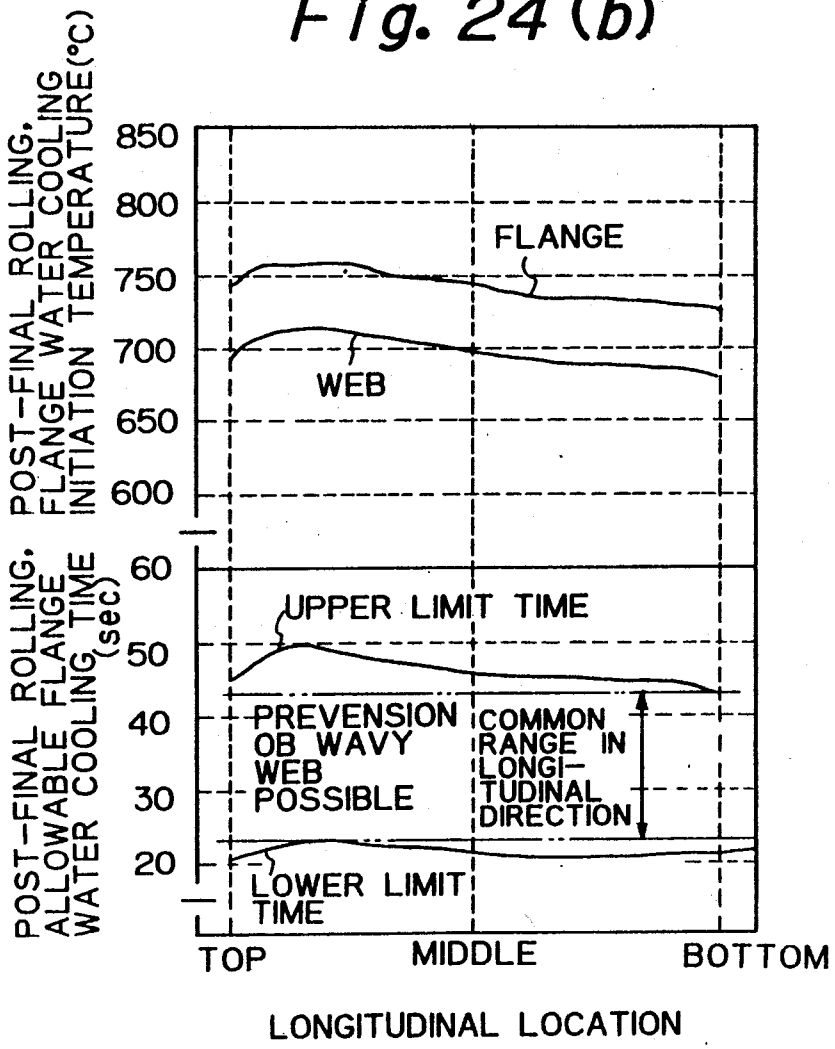

FIGS. 24(*a*) and 24(*b*) show the flange and the web temperatures upon initiation of the flange water cooling for prevention of the wavy web after completion of the final hot rolling and the allowable flange water cooling time predicted from these temperatures, over the steel length, for the conventional process (a) and the present inventive process (b). A cooling water flow quantity density of 400 l/m²-min was used.

When the temperature control according to the present invention was carried out during the intermediate hot rolling, the flange/web temperature difference upon initiation of the flange water cooling after completion of the final hot rolling was reduced and the web temperature was raised, in comparison with the conventional process. It is also seen from FIG. 24(*a*) that, in the conventional process, the allowable time range of the flange water cooling after the final hot rolling is very small at the steel back half at which the web temperature is lowered due to a thermal run down, with the result that prevention of the wavy web is not possible in the steel back half. In fact, the wavy web could not be prevented even when the flange water cooling was carried out for 50 sec by using all of the cooling zones (eleven zones) at a constant steel conveying speed.

In the present inventive process, the allowable time range of the flange water cooling was expanded, a common allowable time range of about 30 sec is present over the steel length, and the lower limit time is small, i.e., a short time water cooling can prevent the wavy web. In fact, the wavy web was prevented completely over the steel length by a flange water cooling for 30 sec by using nine cooling zones at a constant steel conveying speed.

Figure 25:
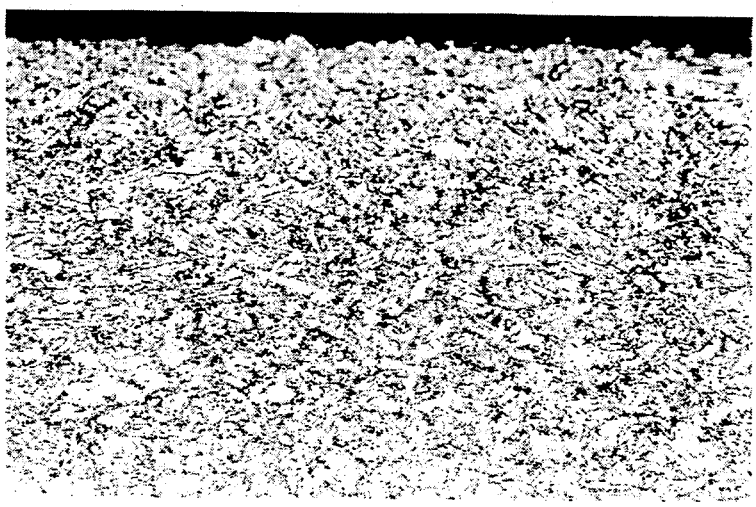
FIGS. 25(*a*) and 25(*b*) are microphotographs, FIG. 25(*a*) showing a microstructure of the flange surface layer of a thin-webbed H-beam steel produced by using a conventional flange water cooling after final hot rolling and FIG. 25(*b*) showing a microstructure of the same portion of a product of the same size produced by a process according to the present invention.
Figure 25:
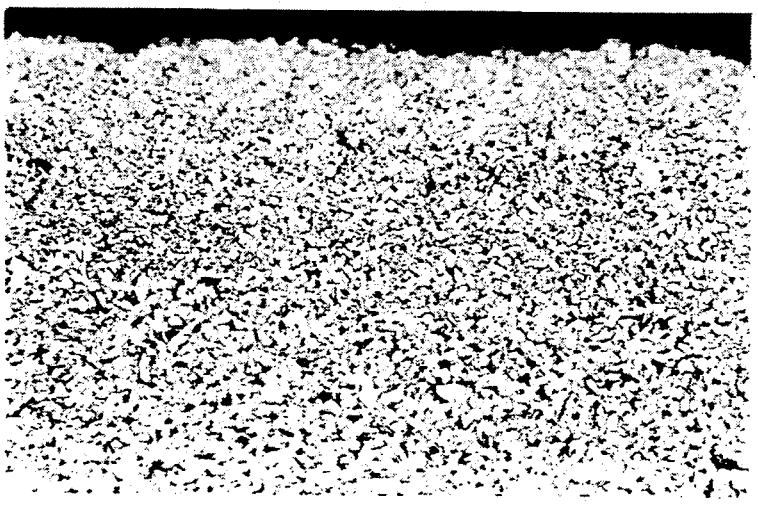

FIG. 25(*a*) shows a microstructure of the flange surface layer of a thin-webbed H-beam steel produced by using a conventional flange water cooling after final hot rolling and FIG. 25(*b*) shows a microstructure of the same portion of the product of the same size produced by a process according to the present invention, in which, during the intermediate hot rolling, a water cooling and a temperature recovery of the flange outer surfaces were alternately repeated as well as the flange cooling after final hot rolling was also carried out. It is seen from these figures that the conventional product has a flange surface layer of a bainitic structure as shown by FIG. 25(*a*) whereas the present inventive product has a flange surface layer of a ferrite-pearlitic structure as shown by FIG. 25(*b*).

Table 3 summarizes the conditions of cooling after final hot rolling and the mechanical properties of the product H-beam steels corresponding to FIGS. 25(*a*) and 25(*b*). In Table 3, the conventional cooling time was longer than that of the present invention, because the former does not effect a cooling during the intermediate hot rolling, and therefore, a longer water cooling time was required in order to prevent the wavy web.

TABLE 3

| | Post-final rolling cooling condition | | Mechanical properties of product thin-webbed H-beam steel | | | |
|---|---|---|---|---|---|---|
| | T-init. (°C.) | Cooling Time (sec) | Y.P. (kg/mm²) | T.S. (kg/mm²) | El. (%) | Surface hardness (HV 10 kg) |
| Conventional (a) | 850 | 50 | 52 | 65 | 12 | 260 |
| Invention (b) | 750 | 30 | 39 | 53 | 28 | 180 |

<Note>
T-init: Flange temperature at which the flange water cooling was initiated after final hot rolling.
Y.P.: yield point
T.S.: tensile strength
El.: total elongation at failure It is seen that the present invention expands the allowable time range of the water cooling after final hot rolling so that a stable prevention of the wavy web is obtained and a high production yield is ensured, and also lowers the lower limit time so that the production efficiency is improved and a good mechanical property is obtained.

The present inventive apparatus also minimizes the delay time of response of the initiation of the coolant water spray.

Figure 26:
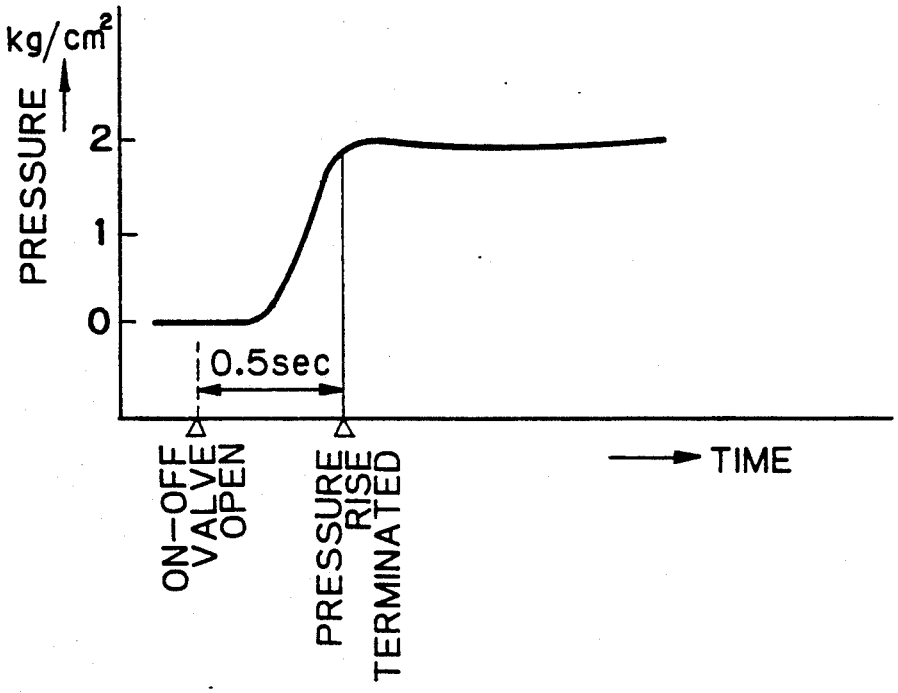
FIGS. 26(*a*) and 26(*b*) show the delay time obtained in processes according to the present invention (a) and the conventional process (b), respectively.
Figure 26:
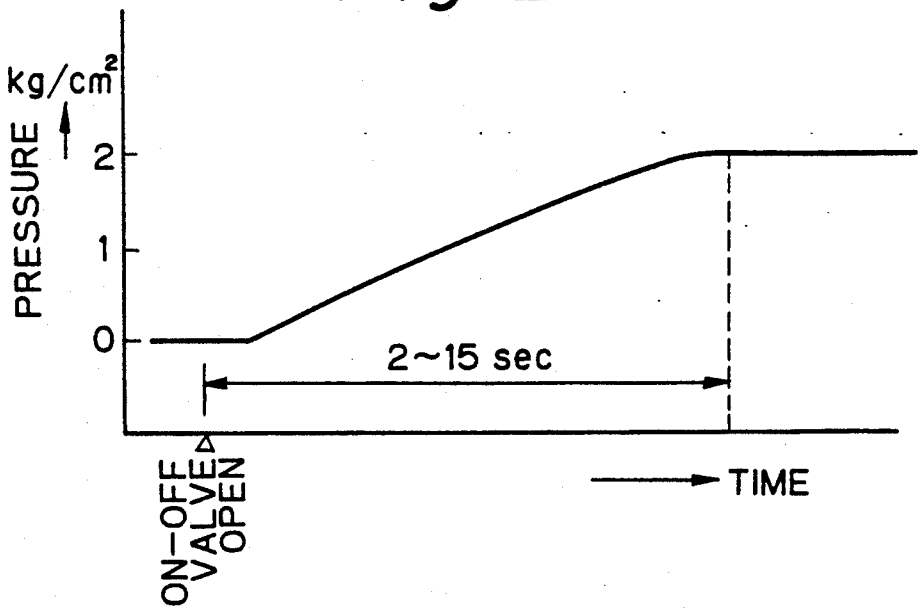

FIG. 26(*a*) and 26(*b*) show the delay time obtained in a processes according to the present invention (a) and the conventional process (b), respectively. The axis of ordinate represents the coolant water pressure within a nozzle header and the axis of abscissa represents the time elapsed. The curve shows the time required for the initial pressure to reach a predetermined value, in terms of seconds elapsed from the opening of an on-off valve, under the following testing condition.

Testing condition

Pressure in header pipe: 2 kg/cm²,
Nominal size of header pipe: 2 in.
Number of nozzles: 15 per one header pipe,
Nominal size of nozzle: ⅜ in.
Flow quantity per nozzle: 7.2 l/min
Piping from on-off valve 4 to header 2: size 1¼, length 10–25 m It is seen from FIG. 26 that conventionally it took 2 to 15 sec from the opening of the on-off valve to the pressure rise and the delay time also had a large fluctuation depending on the capacity of an air reservoir. In the present invention, the delay time is remarkably reduced so that it only took 0.5 sec from the valve opening to the pressure rise and the fluctuation of delay time was also substantially eliminated. Almost the same effect was obtained when the coolant water spray was interrupted.

The present inventive apparatus provides a rapid response and ensures a proper cooling over the H-beam steel length. In a conventional apparatus requiring a delay time of 10 sec, for example, the on-off valve must be opened in advance by 10 sec in order to achieve a predetermined pressure for obtaining a nozzle spray flare angle necessary for cooling whole surface of the flange. But the leading top of an H-beam steel has not yet reached the cooling nozzle position at that time, and therefore, a coolant water passes through the steel top and stays on the upper surface of the web. The web is thus excessively cooled to cause a wavy web and a poor mechanical property. This conventional problem is solved by the present invention because the on-off valve can be opened substantially at the same time as the steel top passes the nozzle position.

In the conventional process, the allowable time range for the flange water cooling after final hot rolling was very small and a long lower limit time was required for some steel sizes, with result that the wavy web could not be completely prevented and the production efficiency lowered. According to the present invention, not only is the wavy web is completely prevented but also the production efficiency is improved, i.e., a thin-webbed H-beam steel can be produced at a high efficiency.

In the conventional process, the flange water cooling after final hot rolling unavoidably raises the flange surface hardness and the accompanied impairment of the mechanical property. According to the present invention, the rise of the flange surface hardness is suppressed merely by an additional cooling/recovery treatment during intermediate hot rolling without using special additive alloying elements, while preventing the wavy web, whereby a thin-webbed H-beam steel can be produced very economically.

The present invention also enables the cooling to be controlled properly in accordance with the material history before rolling, by a zone control of a flange cooling means.

The present invention remarkably improves the precision of the flow control and the response of the initiation and termination of cooling, by a flow control using a three way valve.

We claim:

1. A process for producing a steel thinwebbed H-beam having a selected size and a length, having a web thinner than flanges with said flanges having an outer surface, and with said steel having a microstructure, which comprises the steps of:

forcibly water cooling the outer surface of the flanges during an intermediate hot rolling prior to a final hot rolling, so that the flange outer surfaces are cooled to a temperature of 700° C. or lower;

interrupting said forcible water cooling during the intermediate hot rolling so that the flange outer surfaces are returned to a temperature higher than 700° C.;

repeating said forcible water cooling and said interruption thereof during said intermediate hot rolling to refine the microstructure of the steel of the flange outer surfaces to a predetermined depth from the outer surface;

final-hot rolling the intermediate-hot rolled H-beam steel; and forcibly water cooling the flanges of the final-hot rolled H-beam steel with a selected density of cooling water quantity immediately after completing final hot rolling for a selected cooling time, in a manner such that either the cooling time is not longer than an upper time limit or for a time such that the flange and the web temperature difference upon completion of the forcible water cooling after final hot-rolling is not less than a lower temperature limit, within which upper time limit and lower temperature limit the web does not wave during the forcible water cooling after final hot-rolling, and such that either the cooling time is not less than a lower time limit or for a time such that the flange and the web temperature difference upon completion of the forcible water cooling after final hot-rolling is not more than an upper temperature limit, within which lower time limit and upper temperature limit a thermal stress, generated in the web during air cooling to room temperature, does not exceed a buckling strength of the web, the upper time and temperature limits and the lower time and temperature limits being predetermined with respect to the selected size of the H-beam and the selected density of coolant water quantity.

2. A process according to claim 1, which further comprises:

heating the web simultaneously with said forcible water cooling of the flanges during said intermediate hot rolling, to expand an allowable time range of said forcible water cooling of the flanges after in said final hot rolling, the range being defined by said upper and lower time limits, and to reduce the forcible cooling time.

3. A process according to claim 1 or 2, which further comprises:

providing an intermediate hot rolling line and a final hot rolling line;

selecting predetermined positions along the length of said H-beam as positions for tracking information;

using a means for forcibly cooling the flanges, said cooling means being arranged in the intermediate and final hot rolling lines and having separate cooling control zones which are sequentially operated to spray cooling water to the H-beam steel being hot rolled, based on tracking information of the predetermined positions along the length of said H-beam steel at which said spraying should be carried out.

4. A process according to claim 3, which further comprises:

providing means for conveying said steel H-beam at a selected steel conveying speed;

providing means for determining temperature information at said predetermined positions along the length of said H-beam;

using a piping system having a gate or valve switchable either to said forcible cooling means when said cooling is effected or to a coolant drain when said cooling is not effected; and switching, during hot rolling, said gates or valves corresponding to said cooling control zones to spray coolant water, based on a calculation incorporating therein the steel conveying speed and the temperature information at said predetermined positions along the steel length or based on a predetermined condition, while maintaining a predetermined coolant water flow with respect to the steel size.

* * * * *

UNITED STATES PATENT AND TRADEMARK OFFICE

CERTIFICATE OF CORRECTION

PATENT NO. : 5,191,778

DATED : March 9, 1993

INVENTOR(S) : Akira INGAKI, et al.

It is certified that error appears in the above-identified patent and that said Letters Patent is hereby corrected as shown below:

ABSTRACT, line 1, change "that" to --than--.

Column 6, line 17, change "valves" to --valve--.

Column 6, line 25, change "FIG." to --FIGS.--.

Column 10, line 32, change "a edger" to --an edger--.

Column 11, line 16, between "tail" and "having" insert --from--.

Column 11, lines 42, 46, 48, and 49, change "forcibly" to --forcible--.

Column 11, line 67, delete "of" between "termination" and "thereof.".

Column 13, line 55, change "war" to --way--.

Column 14, line 52, change "FIGS. 19" to --FIG. 19--.

Column 15, line 52, change "is" to --are--.

Column 18, line 20, change "processes" to --process--.

UNITED STATES PATENT AND TRADEMARK OFFICE

CERTIFICATE OF CORRECTION

PATENT NO. : 5,191,778

DATED : March 9, 1993

INVENTOR(S) : Akira INGAKI, et al.

It is certified that error appears in the above-identified patent and that said Letters Patent is hereby corrected as shown below:

Column 19, line 24, change "thinwebbed" to --thin-webbed--.

Column 20, line 17, delete "after".

Column 20, line 31, change "cooling" to --coolant--.

Signed and Sealed this

First Day of February, 1994

Bruce Lehman

*Attest:*

BRUCE LEHMAN

*Attesting Officer*

*Commissioner of Patents and Trademarks*